US008577248B2

(12) United States Patent
Kawasaki et al.

(10) Patent No.: US 8,577,248 B2
(45) Date of Patent: Nov. 5, 2013

(54) IMAGE FORMING APPARATUS

(75) Inventors: Shuhei Kawasaki, Mishima (JP); Motoki Adachi, Ashigarakami-gun (JP); Tomoo Akizuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 419 days.

(21) Appl. No.: 13/038,820

(22) Filed: Mar. 2, 2011

(65) Prior Publication Data

US 2011/0217060 A1 Sep. 8, 2011

(30) Foreign Application Priority Data

Mar. 4, 2010 (WO) ..... PCT/JP2010/053502

(51) Int. Cl.
*G03G 15/16* (2006.01)
*G03G 15/00* (2006.01)
*G03G 21/00* (2006.01)

(52) U.S. Cl.
USPC ..... 399/101; 399/44; 399/129

(58) Field of Classification Search
USPC ..... 399/101, 44, 129, 34, 21, 343, 350
See application file for complete search history.

(56) References Cited

U.S. PATENT DOCUMENTS 6,766,120 B2 * 7/2004 Yokoi ..... 399/21

FOREIGN PATENT DOCUMENTS

JP 2000147914 A * 5/2000

* cited by examiner

*Primary Examiner* — Billy J Lactaoen
(74) *Attorney, Agent, or Firm* — Canon USA Inc. IP Division

(57) ABSTRACT

When toner on an intermediate transfer member is picked up by a cleaning unit by transferring the toner to an image bearing member in a recovery operation, pickup conditions are controlled to be changed on the basis of the ambience detected in performing the recovery operation and such that the toner on the intermediate transfer member is picked up by the cleaning unit while being temporarily retained by a secondary transfer roller.

15 Claims, 15 Drawing Sheets

FIG. 4

| AMOUNT OF TONER CARRIED [%] | | | | | |
|---|---|---|---|---|---|
| 200 | YES | YES | NO | NO | NO |
| 180 | YES | YES | NO | NO | NO |
| 150 | YES | YES | NO | NO | NO |
| 100 | YES | YES | NO | NO | NO |
| 50 | YES | YES | NO | NO | NO |
| 40 | YES | NO | NO | NO | NO |
| 30 | NO | NO | NO | NO | NO |
| 20 | NO | NO | NO | NO | NO |
| | 0 | 10 | 15 | 23 | 30 |
| | TEMPERATURE [°C] | | | | |

| | 1ST | 2ND | 3RD | 4TH | 5TH | 6TH | 7TH | 8TH | 9TH |
|---|---|---|---|---|---|---|---|---|---|
| PICKUP SEQUENCE 1-1 | 800V | 1600V | 2600V | – | – | – | – | – | – |
| PICKUP SEQUENCE 1-2 | 500V | 1000V | 1500V | 2000V | 2600V | – | – | – | – |
| PICKUP SEQUENCE 1-3 | 400V | 800V | 1200V | 1500V | 1800V | 2000V | 2200V | 2400V | 2600V |

FIG. 10

| AMOUNT OF TONER CARRIED [%] | | | | | | | |
|---|---|---|---|---|---|---|---|
| 100 | YES | YES | YES | YES | YES | YES | YES |
| 95 | YES | YES | YES | YES | YES | NO | NO |
| 90 | YES | YES | YES | YES | NO | NO | NO |
| 85 | YES | YES | YES | NO | NO | NO | NO |
| 80 | YES | YES | NO | NO | NO | NO | NO |
| 60 | YES | YES | NO | NO | NO | NO | NO |
| 45 | YES | NO | NO | NO | NO | NO | NO |
| 40 | YES | NO | NO | NO | NO | NO | NO |
| 30 | NO | NO | NO | NO | NO | NO | NO |
| 20 | NO | NO | NO | NO | NO | NO | NO |
| | 0 | 10 | 15 | 20 | 25 | 30 | 35 |

AMBIENT TEMPERATURE [°C]

FIG. 14

PICKUP SEQUENCE α

| AMOUNT OF TONER CARRIED [ % ] | NUMBER OF REVOLUTIONS OF BELT | | | | | | | | |
|---|---|---|---|---|---|---|---|---|---|
| | 1ST | 2ND | 3RD | 4TH | 5TH | 6TH | 7TH | 8TH | 9TH |
| BELOW 50% | 500V | – | – | – | – | – | – | – | – |
| 50% OR LARGER AND BELOW 100% | 500V | 1000V | – | – | – | – | – | – | – |
| 100% OR LARGER AND BELOW 150% | 500V | 1000V | 1500V | – | – | – | – | – | – |
| 150% OR LARGER | 500V | 1000V | 1500V | 2000V | – | – | – | – | – |

PICKUP SEQUENCE β

| AMOUNT OF TONER CARRIED [ % ] | NUMBER OF REVOLUTIONS OF BELT | | | | | | | | |
|---|---|---|---|---|---|---|---|---|---|
| | 1ST | 2ND | 3RD | 4TH | 5TH | 6TH | 7TH | 8TH | 9TH |
| BELOW 50% | 500V | – | – | – | – | – | – | – | – |
| 50% OR LARGER AND BELOW 100% | 500V | 1000V | 1500V | – | – | – | – | – | – |
| 100% OR LARGER AND BELOW 150% | 500V | 1000V | 1500V | 2000V | – | – | – | – | – |
| 150% OR LARGER | 500V | 1000V | 1500V | 2000V | 2600V | – | – | – | – |

PICKUP SEQUENCE γ

| AMOUNT OF TONER CARRIED [ % ] | NUMBER OF REVOLUTIONS OF BELT | | | | | | | | |
|---|---|---|---|---|---|---|---|---|---|
| | 1ST | 2ND | 3RD | 4TH | 5TH | 6TH | 7TH | 8TH | 9TH |
| BELOW 50% | 400V | 800V | – | – | – | – | – | – | – |
| 50% OR LARGER AND BELOW 100% | 400V | 800V | 1200V | 1500V | 1800V | – | – | – | – |
| 100% OR LARGER AND BELOW 150% | 400V | 800V | 1200V | 1500V | 1800V | 2000V | – | – | – |
| 150% OR LARGER | 400V | 800V | 1200V | 1500V | 1800V | 2000V | 2200V | 2400V | 2600V |

IMAGE FORMING APPARATUS

FIELD OF INVENTION

The present invention relates to image forming apparatuses, such as a copier, a printer, and a facsimile, that electrophotographically form images.

DESCRIPTION OF THE RELATED ART

Commercialized image forming apparatuses include an apparatus that forms an image as follows: a toner image formed on a drum-type electrophotographic photosensitive member (hereinafter referred to as drum) is temporarily primary-transferred to an intermediate transfer member, and the toner image transferred to the intermediate transfer member is then secondary-transferred to a sheet of recording material by using a contact-transfer member.

To obtain a good image in an image forming apparatus employing an intermediate transfer member, it is important to remove (to clean off), what is called, secondary-transfer residual toner remaining (not having been transferred to the sheet of recording material) on the intermediate transfer member after secondary transfer from the intermediate transfer member to the sheet of recording material such as a piece of paper.

Hence, there has hitherto been employed a method of scraping secondary-transfer residual toner off with a fur brush or a cleaning blade after secondary transfer and before primary transfer. In this method, the surface of the intermediate transfer member is mechanically rubbed. Consequently, there have been high possibilities of phenomena that the surface of the intermediate transfer member is easily deteriorated and that toner is easily fused onto the intermediate transfer member. There have also been other problems that, for example, a separate container for receiving the toner resulting from the cleaning is necessary. To solve such problems, there is a proposal of a technique in which residual toner on the intermediate transfer member is picked up by a drum cleaning device. In this technique, charging means is provided on, in a direction of movement of the surface of the intermediate transfer member, the downstream side with respect to a secondary transfer position and on the upstream side with respect to a primary transfer nip. The charging means charges secondary-transfer residual toner on the intermediate transfer member with a polarity opposite to that of the potential of the charge of the drum, whereby the toner is picked up at the primary transfer nip by the drum. The toner picked up by the drum is further picked up by the drum cleaning device (Japanese Patent Laid-Open No. 9-50167).

While a toner image on the photosensitive drum is being transferred to the intermediate transfer member or while toner on the intermediate transfer member is being transferred to a sheet of recording material, an image forming operation may be stopped halfway (an emergency stop) because of, for example, failure in the conveyance of the sheet of recording material. The emergency stop refers to a situation in which an image forming operation is stopped halfway before the operation is normally completed. Examples of the emergency stop include a stop due to a stuck sheet of recording material (a jam). At the occurrence of any emergency stop, toner included in a portion of the toner image remaining on the intermediate transfer member that is yet to pass the secondary transfer portion is left negatively charged on the intermediate transfer member. In a case of a four-full-color image, toner images in four colors at maximum are present on the intermediate transfer member. The intermediate transfer member needs to be cleaned of such toner when a recovery operation is performed after the emergency stop. According to a review conducted by the present inventors, however, it has been found that, in a low-temperature ambience, cleaning failure in which toner cannot be picked up by the drum cleaning device may occur if the amount of toner to be transferred from the intermediate transfer member to the drum is too large. This is attributed to reduction in cleanability occurring in a low-temperature ambience and in a case where the cleaning blade is an elastic body made of urethane rubber or the like. Specifically, in a low-temperature ambience, the elasticity of the elastic body is reduced, disabling the blade to follow the run-out of the drum. Consequently, the cleanability is reduced. In such a low-temperature ambience where the cleanability is reduced, if any emergency stop occurs with a large amount of toner being present on the intermediate transfer member and the amount of toner to be transferred from the intermediate transfer member to the drum is large, cleaning failure may occur. In that case, the toner that has not been picked up by the cleaning device may contaminate the charging means and/or the intermediate transfer member, adversely affecting the subsequent image formation.

Accordingly, the present invention excludes the possibilities of the above problems and provides a good pickup sequence.

SUMMARY OF THE INVENTION

Representative means according to the present invention for solving the above problems is an image forming apparatus including an image bearing member configured to bear a latent image, a developing device configured to develop the latent image with toner, a primary transfer device configured to transfer a toner image formed on the image bearing member to an intermediate transfer member, a secondary transfer device configured to transfer the toner image primary-transferred to the intermediate transfer member to a sheet of recording material, and a cleaning device including an elastic cleaning blade being in contact with the image bearing member, the cleaning device being configured to pick up the toner remaining on the image bearing member. The image forming apparatus includes a control device configured to control a pickup sequence in which, after the image forming apparatus has caused any emergency stop, the toner on the intermediate transfer member is returned from the intermediate transfer member to the image bearing member by rotating the intermediate transfer member, whereby the toner is picked up by the cleaning device; and a temperature detecting device configured to detect a temperature when the pickup sequence is performed. Letting temperatures to be detected by the temperature detecting device be a first temperature and a second temperature lower than the first temperature, respectively, the pickup sequence includes a first pickup sequence to be performed at the first temperature and a second pickup sequence to be performed at the second temperature. The second pickup sequence is set such that an amount of toner to be returned from the intermediate transfer member to the image bearing member for each unit area of the image bearing member is smaller than that for the first pickup sequence.

Further features of the present invention will become apparent from the following description of exemplary embodiments with reference to the attached drawings.

BRIEF DESCRIPTION OF DRAWINGS

FIG. 4 is a table showing the relationship between the tolerable amount of toner to be picked up by a cleaning unit and the ambient temperature.

FIG. 10 is another table showing the relationship between the tolerable amount of toner to be picked up by the cleaning unit and the ambient temperature.

FIG. 14 is a diagram explaining tables provided for the pickup sequences in the third embodiment.

DESCRIPTION OF EMBODIMENTS

First Embodiment

Overall Configuration of Exemplary Image Forming Apparatus

Figure 1:
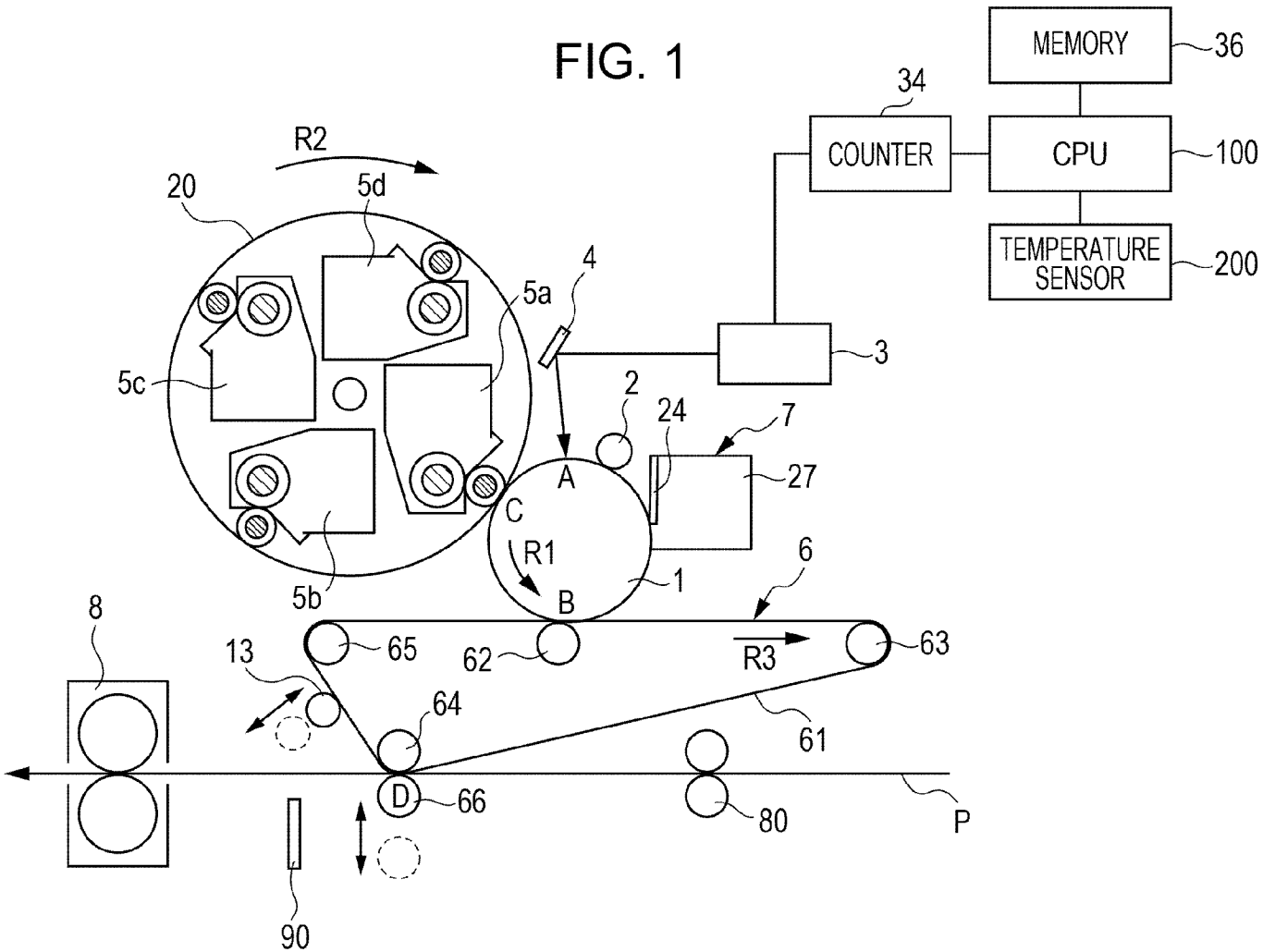
FIG. 1 is a schematic diagram of an image forming apparatus according to a first embodiment.

FIG. 1 is a schematic diagram of an image forming apparatus according to a first embodiment. The image forming apparatus is a four-full-color image forming apparatus employing an electrophotographic process. The image forming apparatus forms an image on a sheet of recording material P as a recording medium on the basis of an electrical image signal that is input from a host apparatus, such as an image reader (document-image-reading apparatus); a personal computer; or a facsimile, to a controller portion (control device: CPU) 100. The controller portion 100 interchanges various pieces of electrical information with the host apparatus and generally controls an image forming operation of the image forming apparatus in accordance with specific control programs and reference tables. The image forming apparatus includes a rotary-drum-type electrophotographic photosensitive member (hereinafter referred to as drum) 1 as an image bearing member configured to bear an electrostatic latent image on the surface thereof. The apparatus further includes, as processing means acting on the drum 1, charging means 2; image exposing means 3; developing means 5 (5*a*, 5*b*, 5*c*, and 5*d*); transferring means 6; and a drum cleaning unit (image-bearing-member-cleaning unit) 7. The drum cleaning unit 7 (a cleaning device) cleans the drum.

The drum cleaning unit 7 includes a cleaning blade 24 and a cleaner container 27.

The cleaning blade 24 is pressed against the drum 1 at a preset angle in such a manner as to be in contact therewith evenly in the longitudinal direction.

The cleaning blade 24 is oriented in the counter direction with respect to the direction of movement of the drum, with the edge at the tip thereof being in contact with the drum.

The cleaning blade 24 is made of urethane rubber and is pasted onto a blade holding plate (a metal sheet), which is a metal plate or the like, thereby being supported by the cleaner container 27.

Thus, the drum 1 is cleaned by scraping toner off the drum 1 at a position where the cleaning blade 24 is in contact with the drum 1.

The toner scraped off the drum 1 by the cleaning blade 24 is received as waste toner by the cleaner container 27. The drum 1 is driven to rotate about its axis counterclockwise in the direction of arrow R1 at a specific speed. The charging means 2 evenly charges the surface of the drum 1 with a potential having a specific polarity (in the first embodiment, negative polarity), and is a contact-charging roller in the first embodiment. The image exposing means 3 forms an electrostatic latent image on the surface of the drum 1 and is a laser scanner unit in the first embodiment. This unit 3 emits a laser beam modulated in accordance with information on images in the respective colors that is input from the host apparatus to the controller portion 100, and performs scan exposure on an exposing site A of the charged surface of the drum 1 through the intermediary of a reflective mirror 4. Thus, an electrostatic latent image is formed on the surface of the drum 1. In the first embodiment, the electrostatic latent image is formed by an image exposure method in which exposure is performed on the charged drum surface in accordance with image information. The developing means 5 (developing device) visualizes the electrostatic latent image formed on the drum surface into a developer image (toner image). The developing means of the image forming apparatus according to the first embodiment includes a plurality of, specifically, four, developing units including first to fourth developing units 5 (5*a*, 5*b*, 5*c*, and 5*d*: developing cartridges). The developing units 5 include respective developing rollers (developer bearing members) configured to bear respective toners. The electrostatic latent image on the drum is developed while the developing rollers are in contact with the drum 1. These developing units are held by a rotary 20 functioning as a developing-unit-holding member (changing means). The rotary 20 is rotatable about a center shaft in an indexing manner. The developing units 5*a*, 5*b*, 5*c*, and 5*d* are removably mounted on respective predetermined mounting portions (developing-means-mounting portions) that are indexed at 90-degree intervals in the direction of rotation of the rotary 20. The rotary 20 is rotated by driving means (not shown), such as a motor controlled by the controller portion 100, clockwise in the direction of arrow R2 in an indexing manner at 90-degree intervals. Thus, the first to fourth developing units 5*a*, 5*b*, 5*c*, and 5*d* are sequentially and switchingly moved to a developing position C that faces the drum 1 as predetermined, thereby developing, at this position, the electrostatic latent image formed on the surface of the drum 1 into a toner image. Here, the position of one of the developing units 5 mounted on the rotary 20 that has been moved to the developing position C facing the drum 1 as predetermined is referred to as being in position C. In the first embodiment, the first to fourth developing units 5*a*, 5*b*, 5*c*, and 5*d* employ a contact-reversal developing method in which nonmagnetic toners whose normal polarity is negative are used as developers. The normal polarity refers to the polarity with which the toner used for development is charged. If reversal development is performed on a negatively charged drum, the normal polarity is negative. In the first embodiment, the first developing unit 5*a* is a yellow (Y) developing unit that contains yellow-colored toner in its developer container. The second developing unit 5*b* is a magenta (M) developing unit that contains magenta-colored toner in its developer container. The third developing unit 5*c* is a cyan (C) developing unit that contains cyan-colored toner in its developer container. The fourth developing unit 5*d* is a black (Bk) developing unit that contains black-colored toner in its developer container. The transferring means 6 transfers the toner image formed on the surface of the drum 1 to the recording medium and is an intermediate-transfer-belt unit (hereinafter referred to as unit) 6 in the first embodiment. The unit 6 includes an intermediate transfer belt (hereinafter referred to as belt) 61 as an intermediate transfer member (a first recording medium). The belt 61 is dielectric and flexible, and has such a circumference that an image of a size corresponding to the maximum size (in the first embodiment, size A4) of the recording material P can be formed thereon. The transferring means 6 further includes a primary transfer roller 62, a belt driving roller 63, a secondary-transfer counter roller 64, and a tension roller 65, around all of which the belt 61 is stretched. The primary transfer roller 62 as a primary transfer device is pressed against the drum 1 with the belt 61 interposed therebetween. The portion of contact between the drum 1 and the belt 61 corresponds to a primary transfer nip portion B. Secondary transfer means (a secondary transfer device) transfers the toner image formed on the belt to a sheet of recording material. The secondary transfer means includes a secondary transfer roller. The secondary transfer roller 66 faces a portion of the secondary-transfer counter roller 64 on which the belt runs. The secondary transfer roller 66 is moved by a swinging mechanism (not shown) between an acting position where the secondary transfer roller 66 is pressed against the secondary-transfer counter roller 64 with the belt 61 interposed therebetween and a non-acting position where the secondary transfer roller 66 is held away from the surface of the belt 61. The secondary transfer roller 66 is at the non-acting position while Y, M, C, and Bk toner images are sequentially primary-transferred from the drum 1 to the belt 61. Subsequently, before the leading end of the four-color toner image (full-color image) yet to be fixed on the belt 61 reaches the position facing the secondary transfer roller 66 along with the movement of the belt 61, the secondary transfer roller 66 is moved to the acting position.

The portion of contact between the secondary transfer roller 66 that has been moved to the acting position and the belt 61 corresponds to a secondary transfer nip portion D.

Meanwhile, a sheet of recording material P as a second recording medium is separated and is fed from a recording-material-feeding portion (not shown) with a specific control timing.

The sheet of recording material P is guided into the secondary transfer nip portion D, which is the portion of contact between the secondary transfer roller 66 and the belt 61, with a specific control timing based on a registration sensor 80.

A secondary transfer bias of a specific potential having a polarity (positive) opposite to the toner charging polarity is applied to the secondary transfer roller 66.

Thus, while the sheet of recording material P is nipped and conveyed through the secondary transfer nip portion D, a set of four superposed color toner images on the belt 61 is duly secondary-transferred to the surface of the sheet of recording material P.

The sheet of recording material P is released from the surface of the belt 61 and is guided to a fixing unit 8, where the sheet of recording material P is heated and pressed at a fixing nip portion.

Thus, the set of color toner images is fixed (fused and mixed) onto the sheet of recording material P.

Furthermore, a single-layer, solid, toner charging roller 13 is provided on the outer periphery of the belt 61. The toner charging roller 13 is movable by a swinging mechanism (not shown) in such a manner as to be in contact with and away from the belt 61. The toner charging roller 13 is positioned, in the direction of movement of the belt 61, on the downstream side with respect to the secondary transfer nip portion D and on the upstream side with respect to the primary transfer nip portion B. The toner charging roller 13 is connected to a toner-charging-roller-bias power supply (not shown), so that a bias (in the first embodiment, a positive direct-current bias, which is of the opposite polarity to the normal toner charging polarity) is applied thereto. The toner charging roller 13 is held at a non-acting position (away position) during image formation, and is moved to an acting position (contacting position) when a below-described specific operation of picking up secondary-transfer residual toner (belt cleaning) after the completion of image formation is performed after image formation.

Method of Picking Up Secondary-Transfer Residual Toner After Completion of Full-Color Image Formation After the toner image is subjected to secondary transfer from the belt 61 to a sheet of recording material P, secondary-transfer residual toner is present on the surface of the belt 61 from which the sheet of recording material P has been released. This is because an image force acts between the belt 61 and the toner during secondary transfer, and it is difficult to realize a transfer efficiency of 100% by an electrostatic method. Hence, the following belt cleaning is performed: the polarity of secondary-transfer residual toner that has not been secondary-transferred and remains on the belt 61 is changed to be positive, opposite to the original polarity, by the toner charging roller 13, and the residual toner is thus electrostatically transferred to the drum 1. Specifically, a positive toner-charging-roller bias is first applied from a toner-charging-roller-bias power supply (not shown) to the toner charging roller 13 after secondary transfer. In the first embodiment, the toner-charging-roller bias to be applied is a direct-current bias that is controlled at a constant current. Subsequently, after a specific period of time from the application of the toner-charging-roller bias, the toner charging roller 13 is brought into contact with the belt 61. Hence, the secondary-transfer residual toner is positively charged by the toner charging roller. The surface of the drum 1 has a negative potential. The primary transfer roller 62 is charged with a positive transfer bias. Accordingly, an electric field is produced between the drum 1 and the belt 61, and a force acting in a direction toward the drum 1 is exerted on the positively charged toner that has reached the primary transfer nip portion along with the movement of the belt 61. This causes the toner on the belt to be transferred to the drum 1, whereby the toner can be picked up by the cleaning unit of the drum 1. Furthermore, after the completion of the cleaning along with the completion of one revolution of the belt 61, the application of the toner-charging-roller bias to the toner charging roller 13 is turned off. After a specific period from when the application of the toner-charging-roller bias has been turned off, the toner charging roller 13 is moved away from the belt 61.

Method of Picking Up Secondary-Transfer Residual Toner in Monochrome Image Mode

In a monochrome-image-forming mode, image formation by the fourth developing unit 5*d* for black color is only performed. This image formation is performed with the secondary transfer roller 66 and the toner charging roller 13 being at the respective acting positions. The polarity of secondary-transfer residual toner is changed to be positive, opposite to the original polarity, by the toner charging roller 13. In this state, the drum 1 is negatively charged, and the primary transfer roller 62 is charged with a positive bias. Therefore, the toner on the belt is transferred to the drum 1 with the aid of an electric field produced at the primary transfer nip portion B. Thus, the toner can be picked up by the cleaning unit of the drum 1. When a monochrome-image-forming job for one or a plurality of successive sheets is completed, the controller portion 100 resets the image forming apparatus to go stand by for another image-formation-start signal to be input thereto.

Sheet Sensor

In the image forming apparatus according to the first embodiment, the presence/absence of any sheet of recording material is detected by the registration sensor 80 shown in FIG. 1. Furthermore, a sheet eject sensor 90 is provided. The registration sensor 80 is for registering a sheet of recording paper and the developer image formed on the belt 61, and is provided between a recording material stacker and the secondary transfer nip portion D in the direction of conveyance of the recording material. The sheet eject sensor 90 is for checking whether or not any sheet of recording material has been ejected, and is provided between the secondary transfer nip portion D and the fixing unit 8 in the direction of conveyance of the recording material. If a sheet of recording material that has been detected by the registration sensor 80 has not been detected by the sheet eject sensor 90 before a predetermined period of time elapses, it is detected that a jam has occurred between the registration sensor 80 and the sheet eject sensor 90. Furthermore, if the sheet eject sensor is not turned off (the sheet of recording material continues to be detected) when another predetermined period of time has elapsed after the sheet of recording material has been detected by the sheet eject sensor 90, it is detected that a jam has occurred in the fixing unit. In a state where a jam has occurred in the fixing unit, a sheet of recording material has already passed the secondary transfer nip portion D, and the toner image has already been transferred to the sheet of recording material at the secondary transfer nip portion D. In either case, such information from the sensor is processed by the controller portion (control device: CPU) 100, and the user is notified of the occurrence of the jam. In the first embodiment, the position of a sheet of recording material in the image forming apparatus is located by using the sensors. Alternatively, the position of a sheet of recording material may be located on the basis of, for example, a time period measured from when the sheet of recording material has been picked up from the stacker.

Detection of Ambience

The image forming apparatus according to the first embodiment includes a temperature sensor 200 that detects the temperature of an ambience in which the image forming apparatus is installed. The temperature sensor 200 is constantly under supervision by the controller portion (control device: CPU) 100. The temperature detected by the temperature sensor is referred to in controlling the biases to be applied to the charging device and the developing device and in switching between pickup sequences for a recovery operation to be performed after any emergency stop. The temperature sensor 200 preferably detects, but is not limited to detect, the temperature near the cleaning blade 24. The temperature sensor only needs to be at such a position in the apparatus that the correlation with the temperature near the cleaning blade 24 can be found.

Maximum Amount of Toner Carried

In forming an image, if the total amount of toners to be used is large, scattering of toners may occur when superposed toners are transferred to a sheet or to the transfer belt, or before and after a sheet passes the fixing unit. Moreover, the way the toners are scattered varies with changes in toner charge and in transfer efficiency caused by subtle changes in temperature and humidity and by the deterioration-with-use of the drum; the toners; the fixing unit; and the intermediate transfer member. To prevent the scattering of toners in spite of such changing factors, some settings are made for limiting the amount of toners. In the first embodiment, the controller portion (control device: CPU) 100 controls the total amount of toners having the four colors of Y, M, C, and Bk not to exceed 200%, with the amount of toner carried by the belt 61 for formation of a solid black monochrome image being 100%. In the first embodiment, the density is adjusted by controlling the PWM (pulsed emission time) of the image exposing means 3, i.e., the laser scanner unit.

Method of Calculating the Amount of Toner Carried

The image forming apparatus according to the first embodiment includes a pixel counting (video counting) device 34. The pixel counting device 34 counts printing pixels, which are the pixels to which toner is to be applied, on the basis of image data that is input thereto. This operation is referred to as video count. In the first embodiment, the amount of toner required for image formation is calculated by totalizing the duration of laser emission by the pixel counting device 34. As the number of printing pixels counted increases, the amount of toner carried by the drum for development increases, and correspondingly the amount of toner transferred from the drum to the belt 61 increases. Therefore, by counting pixels, the amount of toner remaining over the entirety of the belt at the occurrence of any emergency stop can be estimated. The amount of toner carried, which will be described below, is calculated from the video count information in the following manner. In the first embodiment, the amount of toner carried is defined with the amount of toner required for forming a solid black image being 100%. Now, with reference to the video count when a solid black image is formed, the amount of toner carried will be calculated. For example, in a case where an image corresponding to half the video count for forming a solid black image is formed, the amount of toner carried comes to 50%.

Pickup Sequences After Emergency Stop

Figure 2:
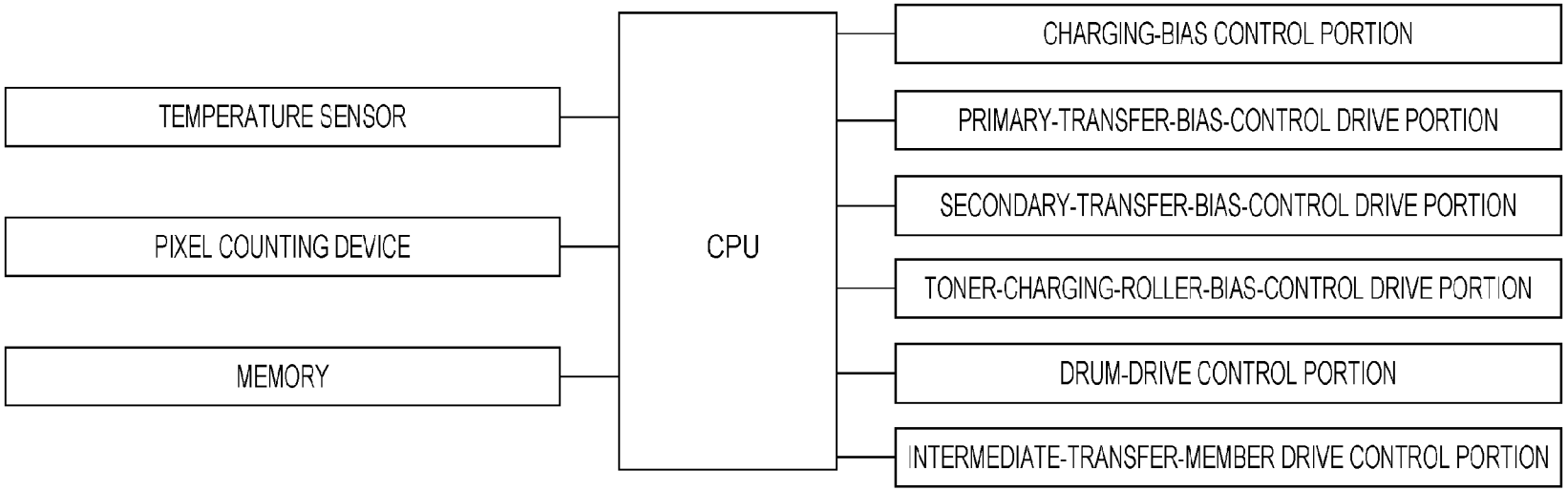
FIG. 2 is a block diagram explaining a control device and so forth that perform pickup sequences.

FIG. 2 shows the control device and so forth that perform pickup sequences to be performed after any emergency stop, which is a major feature of the first embodiment. The control device, i.e., the controller portion (CPU) 100, performs various bias-control-drive operations on the basis of temperature information, video count information, and memory information. Specifically, the CPU 100 determines whether or not any emergency stop has occurred on the basis of information from the registration sensor 80 and the sheet eject sensor 90. If any emergency stop has occurred, a pickup sequence is performed when an operation of recovering from the emergency stop is performed. There are provided two pickup sequences for different pickup conditions. The pickup sequences are stored in a memory 36. The CPU 100 retrieves from the memory 36 an optimum pickup sequence referring to the video count information from the counting device 34 and the ambient temperature indicated by the temperature sensor 200, and switches the operation thereto. In accordance with the pickup sequence, the CPU controls a charging-bias control portion, a primary-transfer-bias-control drive portion, a secondary-transfer-bias-control drive portion, a toner-charging-roller-bias-control drive portion, a drum-drive control portion, and an intermediate-transfer-member-drive control portion. A first pickup sequence will now be described.

Pickup Sequence 1

Pickup Sequence 1 according to the first embodiment will now be described. In a recovery operation performed after any emergency stop, the following pickup sequence is performed. In the pickup sequence, the belt 61 and the drum 1 are rotated. Toner picked up from the belt 61 by the drum 1 is picked up by the cleaning device along with the rotation of the drum. Most of the toner that is present on the belt 61 at the occurrence of any emergency stop has a negative polarity, which is the normal polarity. Nevertheless, some of the toner on the belt 61 has a positive polarity because of an effect of the transfer bias. Therefore, to pick up the toner on the belt 61, the following pickup sequence is performed.

(1) While the belt 61 completes two revolutions, a negative bias of −1000 V is applied to the primary transfer roller 62, and the bias application to the charging roller is turned off, whereby the potential of the drum 1 is set to substantially 0 V. In this operation, the secondary transfer roller 66 and the toner charging roller 13 are held away from the belt 61. In operation (1), negatively charged toner is picked up. Most of the toner that is present on the belt at the occurrence of any emergency stop is negatively charged. Therefore, most of the toner can be picked up in operation (1).

(2) Subsequently, while the belt 61 completes one revolution, the secondary transfer roller 66 and the toner charging roller 13 are brought into contact with the belt 61, and a positive bias of +2000 V is applied to each of the secondary transfer roller 66 and the toner charging roller 13 so that the residual toner on the belt 61 is positively charged. The primary transfer roller 62 is charged with a positive bias of 2000 V. The charging roller is charged with a negative bias, with the dark-area potential of the drum being −500 V. In this operation, the toner is positively charged by the toner charging roller 13 and is picked up by the drum with the aid of an electric field produced at the primary transfer nip portion B. In operation (1), most of the negatively charged toner has been picked up. In operation (2), the positively charged toner, some negatively charged toner that has not been picked up in operation (1), some toner whose charge is near zero, and so forth are positively charged by the toner charging roller and so forth, thereby being picked up by the drum. Meanwhile, some of the toner is temporarily and electrically retained by the secondary transfer roller and so forth. At this point of time, substantially all of the residual toner on the belt 61 has been picked up.

(3) Subsequently, while the belt 61 completes one and a half revolutions, a bias including a positive bias and a negative bias that are alternated periodically is applied so that toner accumulated on the secondary transfer roller 66 and the toner charging roller 13 is discharged. Specifically, in a state where the secondary transfer roller 66 and the toner charging roller 13 are in contact with the belt 61, voltages of +1000 V and −1000 V are alternately applied to the secondary transfer roller 66 and the toner charging roller 13. It has been confirmed that the toner adhered to the secondary transfer roller and so forth are transferred to the belt 61 by alternating the biases to be applied. In this operation, the transfer biases are alternated in such a manner as to produce an electric field that causes the toner that has been discharged from the secondary transfer roller 66 and the toner charging roller 13 and has reached the primary transfer nip portion B to be picked up by the drum 1. This will be described more specifically. The toner discharged from the secondary transfer roller 66 and the toner charging roller 13 at the application of +1000 V is positively charged. When this toner has reached the primary transfer nip portion B, a primary transfer bias of +1000 V is applied. Since charging of the drum at this point of time is off, the positively charged toner is electrostatically picked up by the drum. Likewise, when the toner discharged from the secondary transfer roller 66 and the toner charging roller 13 at the application of −1000 V has reached the primary transfer nip portion B, a primary transfer bias of −1000 V is applied. Since charging of the drum at this point of time is off, the negatively charged toner is electrostatically picked up by the drum. The duration of each application is 350 msec. While the belt 61 completes one and a half revolutions (it takes 3.8 sec per revolution of the belt), the positive and negative biases are alternately and repetitively applied for 350 msec each. Thus, the discharged toner is picked up by the drum. In operation (3), the toner that has adhered to the secondary transfer roller and so forth in operation (2) is picked up by the drum 1. Consequently, the secondary transfer roller can be cleaned up.

Pickup Sequence 2

In a case where the ambient temperature is low and a large amount of toner remains not having been picked up by Pickup Sequence 1, Pickup Sequence 2 is started on the basis of results of Preparatory Review 1, which will be described below.

Figure 3:
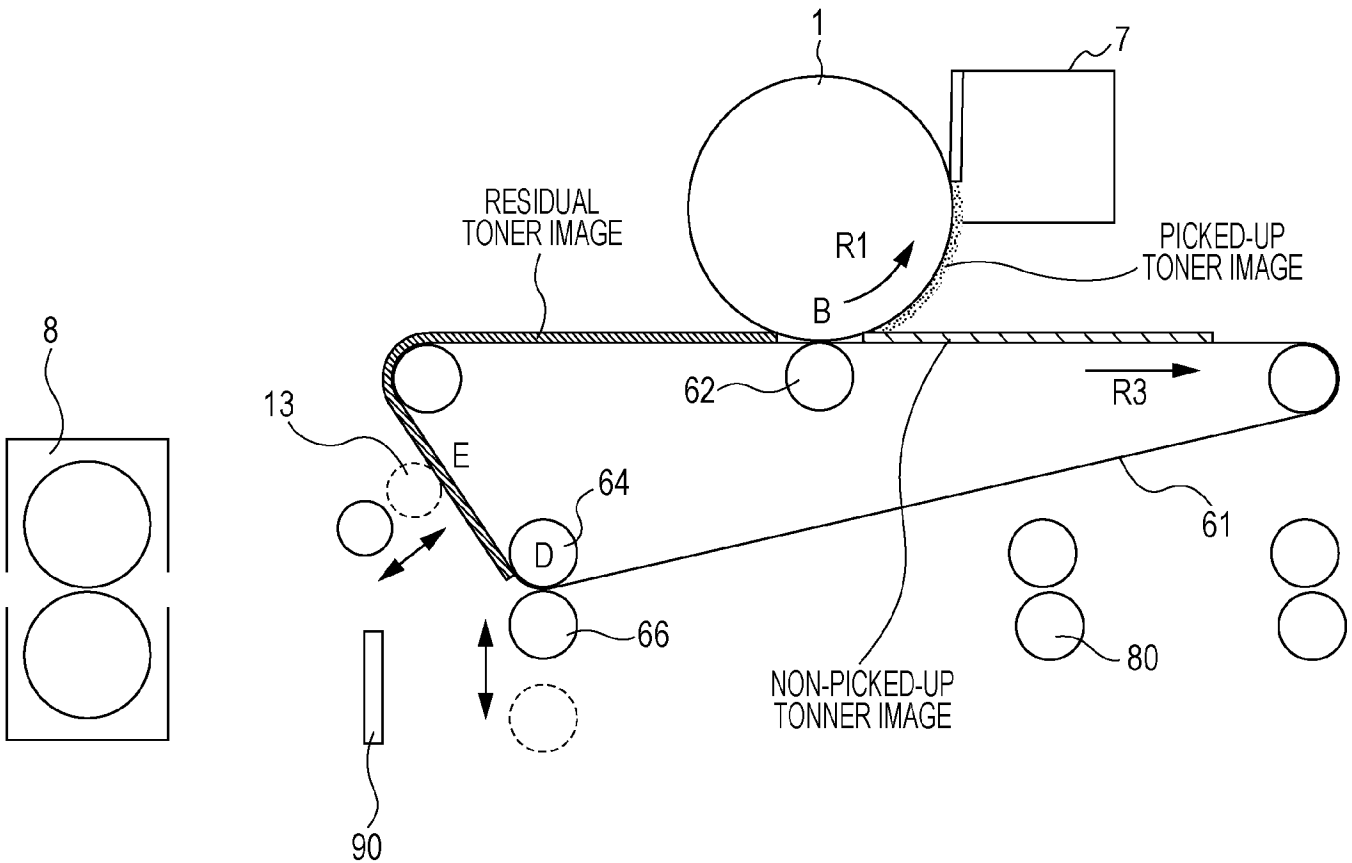
FIG. 3 is a diagram explaining a pickup sequence.

Pickup Sequence 2 is characterized in that, when toner is picked up from the belt 61 by the drum 1, some of the residual toner on the belt 61 is temporarily picked up by the secondary transfer roller 66. Specifically, when toner is to be picked up from the belt 61 by the drum 1, the secondary transfer roller 66 is brought into contact with the belt 61 as shown in FIG. 3, and a secondary transfer bias is applied. Thus, some of the residual toner on the belt 61 is temporarily retained by the secondary transfer roller 66. At the same time, while a charge is applied to the residual toner on the belt, an amount of toner not exceeding the tolerable amount of pickup is picked up by the drum with the aid of an electric field produced between the primary transfer roller 62 and the drum 1. Details of the sequence will now be described.

(1) The secondary transfer roller 66 is brought into contact with the belt 61, and a positive bias of +1000 V is applied thereto. Meanwhile, a positive bias of +900 V is applied to the primary transfer roller 62, and a charging bias for giving a dark-area potential of −500 V is applied to the drum. While the belt 61 completes five revolutions, some of the residual toner on the belt is retained by the secondary transfer roller 66, and toner that has not been retained by the secondary transfer roller 66 is electrostatically picked up at the primary transfer nip portion B by the drum 1. During this operation, the toner charging roller 13 is held away from the belt 61. The secondary transfer roller 66 retains some of the negatively charged toner that has been on the belt 61. The drum 1 successively picks up the positively charged toner on the belt 61 at the primary transfer nip portion B. Specifically, in the first revolution of the belt, some residual toner on the belt is electrostatically picked up by the drum 1 while other is retained by the secondary transfer roller 66. In the second revolution of the belt, residual toner that has not been picked up in the first revolution is present on the belt. Here, the residual toner on the belt is positively charged again with the positive bias of +1000 V that has been applied to the secondary transfer roller 66. When the belt rotates, this toner reaches the primary transfer nip portion B and is electrostatically picked up by the drum 1. By repeating this operation for the third, fourth, and fifth revolutions, some residual toner on the belt 61 is retained by the secondary transfer roller 66, and other residual toner that has not been retained is mostly picked up by the drum 1. Compared with operation (2) of Pickup Sequence 1, the bias that is applied to the secondary transfer roller 66 is low. The reason for this is as follows. If a bias of +2000 V is applied to the secondary transfer roller 66 as in operation (2) of Pickup Sequence 1, most of the toner on the belt 61 is positively charged. In operation (1) of Pickup Sequence 2, a large amount of toner remains untransferred on the belt 61. In such a situation, if a bias of +2000 V is applied to the secondary transfer roller 66, some of the toner adheres to the secondary transfer roller, whereas some other toner is positively charged and passes the secondary transfer nip portion D. Here, if the bias to be applied to the secondary transfer roller 66 is too high, the amount of toner to be positively charged increases. Consequently, a large amount of positively charged toner reaches the primary transfer nip portion B. This increases the possibility that the tolerable amount of pickup by the drum 1 is exceeded. Hence, in operation (1) of Pickup Sequence 2, the bias to be applied to the secondary transfer roller 66 is low. Since operation (2) of Pickup Sequence 1 is performed after operation (1) of Pickup Sequence 1, the amount of toner on the belt 61 is not so large. Therefore, even if the bias to be applied to the secondary transfer roller 66 is high, there is no possibility that a large amount of toner reaches the primary transfer nip portion B.

(2) Subsequently, while the belt 61 completes two revolutions, a negative bias of −1000 V is applied to the primary transfer roller 62, and the bias application to the charging roller is turned off, whereby the potential of the drum 1 is set to substantially 0 V. Meanwhile, the secondary transfer roller 66 and the toner charging roller 13 are held away from the belt 61. In this operation, the negatively charged toner on the belt 61 is picked up at the primary transfer nip portion B by the drum 1 with the aid of an electric field. In operation (2), the negatively charged toner that has not been picked up by the secondary transfer roller in operation (1) is picked up by the drum 1.

(3) When the belt 61 is rotated by five revolutions in operation (1) and two revolutions in operation (2), substantially all of the toner on the belt 61 can be picked up. Subsequently, to discharge toner accumulated on the secondary transfer roller 66, a control operation similar to operation (3) of Pickup Sequence 1 is performed. With the secondary transfer roller 66 being in contact with the belt 61, the belt 61 is rotated by three revolutions while the applications of a positive bias and a negative bias are alternated periodically. During this operation, the toner charging roller 13 is held away from the belt 61. In this operation, the toner is picked up by the drum by alternating the charging biases in such a manner as to produce an electric field that causes the toner discharged from the secondary transfer roller 66 and the toner charging roller 13 to be picked up at the primary transfer nip portion B by the drum 1. While the belt 61 completes three revolutions, the discharged toner is picked up by the drum at 350-msec intervals of application. Comparing the control operation (3) of Pickup Sequence 1 and the control operation (3) of Pickup Sequence 2 as recovery sequences, the control operation (3) of Pickup Sequence 2 is longer. The reason for this is as follows. In operation (3) of Pickup Sequence 2, since toner is actively retained by the secondary transfer roller 66, the duration of toner discharge from the secondary transfer roller needs to be sufficiently long. In this operation, a large amount of toner is prevented from being picked up from the belt 61 by the drum 1. This is because, if a large amount of toner is transferred to the drum 1, cleaning failure may occur. To prevent a large amount of toner from being picked up from the belt 61 by the drum 1, the amount of toner to be discharged from the secondary transfer roller 66 to the belt 61 is prevented from increasing. To do so, the bias to be applied to the secondary transfer roller and the duration of application are optimized.

Figure 5:
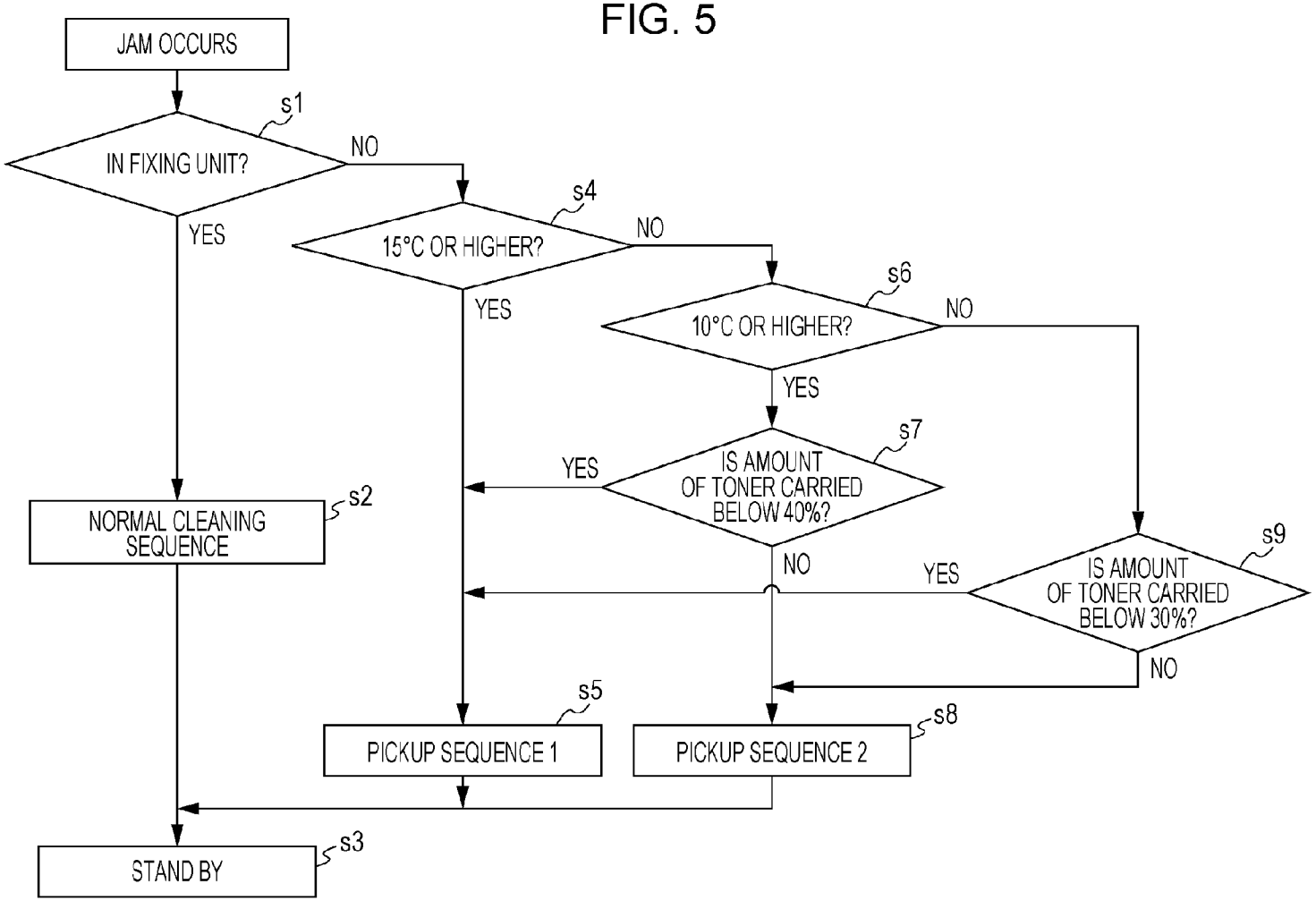
FIG. 5 is a diagram explaining an operational flow for pickup sequences performed after any jam has occurred.

When Pickup Sequence 2 described above was conducted in an ambience at 0° C., where the tolerable amount of pickup is the lowest in Pickup Sequence 1 according to the first embodiment, no pickup failure occurred, and an amount of toner carried by the belt of 200% was able to be picked up. Pickup Sequence 1 and Pickup Sequence 2 differ from each other in that the amount of toner returned, during the pickup operation, from the belt 61 to the drum 1 at a time for each unit area of the drum is smaller in Pickup Sequence 2 than in Pickup Sequence 1. The amount of toner returned to the drum 1 for each unit area of the drum mentioned herein is expressed as follows. The amount of toner returned to the drum 1 for each unit area of the drum=(the total amount of toner returned from the belt 61 to the drum 1/the total area of the drum 1 by which toner returned from the belt 61 is received). A situation where the amount of toner per unit area of the drum is small means that not a large amount of toner has been transferred from the belt 61 to the drum 1. As shown in FIG. 5, at an ambient temperature (15 to 30° C.) at which the allowance for cleaning performance is relatively large, Pickup Sequence 1 is performed so that the amount of toner per unit area is increased with a large potential difference. Therefore, toner can be picked up in as short time as possible. In contrast, in a low-temperature ambience (below 15° C.), pickup failure may occur when the amount of toner per unit area at the time of pickup is large. Therefore, if the amount of toner at the occurrence of any emergency stop is large in a low-temperature ambience (below 15° C.), a method needs to be taken in which an assured pickup operation is realized, avoiding any problems, by reducing the amount of toner per unit area. In the first embodiment, when the temperature is so low as to reduce the cleaning performance and the amount of toner carried is large, some toner is temporarily retained by the secondary transfer roller 66. Consequently, the amount of toner reaching the primary transfer nip portion B can be reduced. Thus, toner is picked up by reducing the amount of toner to be picked up at the primary transfer nip portion B by the drum for each unit area of the drum. There is another pickup method in which, as described below in a second embodiment, the bias to be applied to the primary transfer nip portion B is changed in a graded manner, instead of using the secondary transfer roller 66 and the toner charging roller 13. In such a method, however, the downtime required for pickup is longer than in the first embodiment. The first embodiment can prevent the occurrence of pickup failure and can shorten the downtime required for recovery as much as possible at the time of recovery after any emergency stop occurring when the temperature is so low as to reduce the cleaning performance and the amount of toner carried is large.

Preparatory Review 1

A review was conducted about the correlation between the limit of the amount of toner that could be picked up in Pickup Sequence 1 according to the first embodiment without causing pickup failure of the cleaning blade and the corresponding ambient temperature around the image forming apparatus. The review was conducted with a cleaning device (having a nominal drum life for 80000 sheets) according to the first embodiment that had undergone the running of 80000 full-color sheets, and optimum conditions for picking up the toner in each of different ambiences were examined. The reason why such an experiment was conducted with the cleaning device that had undergone the running of 80000 sheets of recording material in the full-color-image-forming mode is to take into account the fact that repeated performance of image formation damages the drum with scars and therefore reduces the cleanability. If cleaning can be performed in a good manner with a drum having reduced cleanability after performances of image formation, cleaning can be performed in a good manner with a fresh drum.

Method

Images having various densities were developed on the drum of the image forming apparatus according to the first embodiment, and the images were primary-transferred to the belt 61. During this operation, an emergency stop of the apparatus was made to occur, whereby a situation where toner was present on the belt 61 was produced. Subsequently, an area of the drum swept by the cleaning blade after the residual toner on the belt 61 had been picked up by Pickup Sequence 1 was visually examined, and whether or not slipping-through of toner had occurred was checked. This review was conducted at a processing speed the same as the speed at which plain paper is caused to run through the image forming apparatus.

Results

The results are shown in FIG. 4. The horizontal axis represents the ambient temperature around the image forming apparatus, and the vertical axis represents the amount of toner carried, with the amount of toner carried for a solid black monochrome image being 100. Cases where slipping of toner through the cleaning blade did not occur are represented by NO, and cases where slipping of toner through the cleaning blade (pickup failure) occurred are represented by YES. According to the results, when high-print-rate image formation in which the amount of toner carried was large (for example, a case where the amount of toner carried was 180% or 200%) was performed in a low-temperature ambience (for example, 0° C. or 10° C. in FIG. 3), pickup failure occurred in some cases. This is attributed to the fact that, in a low-temperature ambience, the hardness of the blade is increased and the elasticity of the blade is therefore reduced, whereby the blade's capability of following the run-out of the drum is reduced. This preparatory review has showed that, when the ambient temperature is low and the amount of toner carried by the belt is large, slipping-through of toner occurs if it is attempted to cause the drum 1 to pick up the toner on the belt 61 at a time.

Selecting a Pickup Sequence at Emergency Stop

Two exemplary cases of emergency stop of the image forming apparatus will be described: (1) a case of a stuck sheet of recording material (hereinafter referred to as a jam), and (2) a case of main power stoppage due to a blackout or the like. Methods of switching between the pickup sequences in the two cases will now be described in detail. Such a case classification is based on the difference between the foregoing cases in the amount of toner remaining on the intermediate transfer member before the emergency stop. In each of the cases, the amount of toner remaining on the belt is estimated by calculating with the CPU 100 (calculating device) in accordance with image information obtained before the emergency stop.

In Case of Stuck Sheet of Recording Material

Figure 6A:
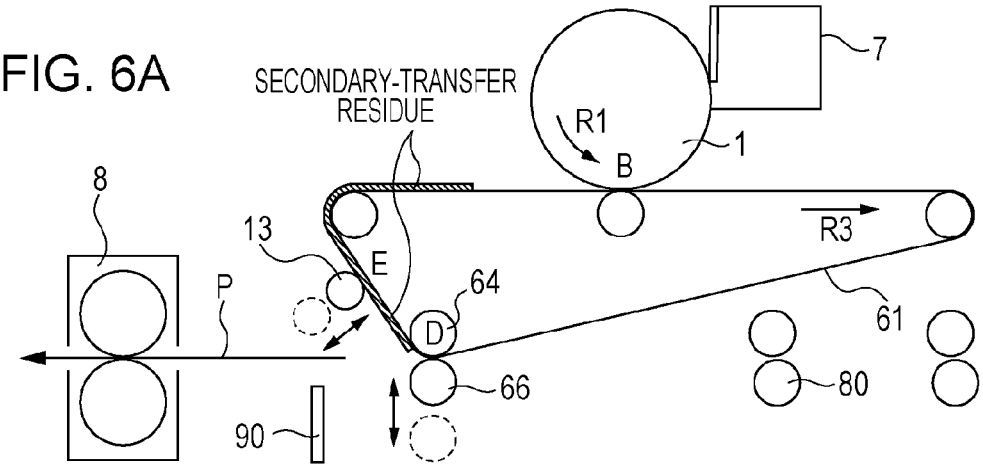
FIG. 6A is a diagram explaining a pickup sequence performed after any jam has occurred.
Figure 6B:
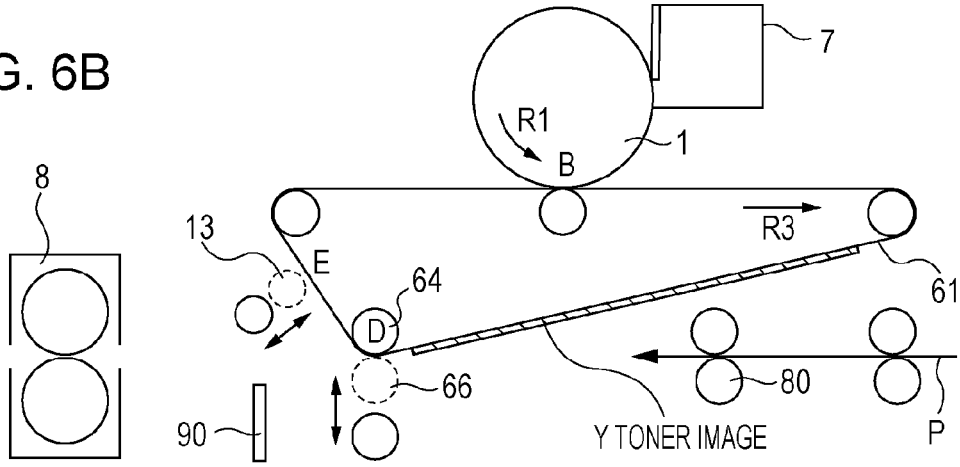
FIG. 6B is a diagram explaining another pickup sequence performed when any jam has occurred during sheet feeding.
Figure 6C:
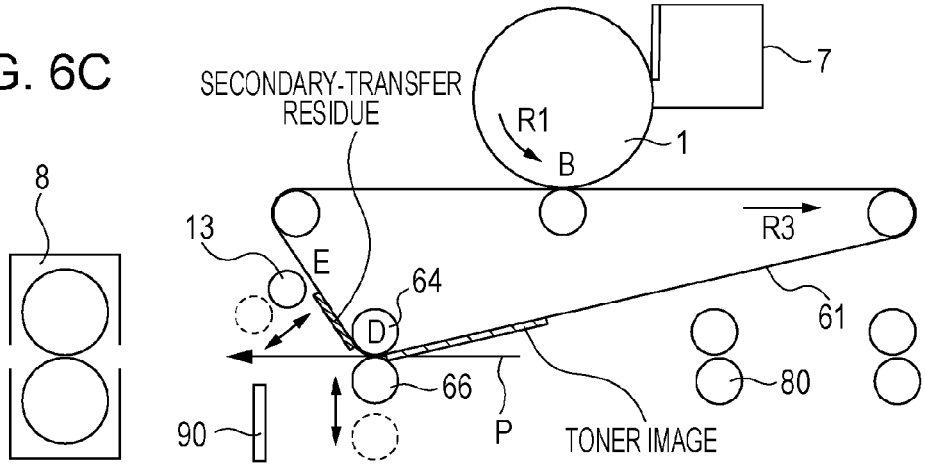
FIG. 6C is a diagram explaining yet another pickup sequence performed when any jam has occurred at any other position.

FIG. 5 shows pickup sequences performed in the case where a sheet of recording material has been stuck during full-color image formation in the first embodiment. FIG. 6A shows where the toner image is on the belt 61 when the sheet eject sensor 90 has detected that a jam has occurred in the fixing unit. A jam occurring in the fixing unit suggests a situation where a sheet of recording material has been stuck while passing through the fixing unit. In this situation, since the sheet of recording material P has already passed the secondary transfer roller 66, the entirety of the toner image on the belt 61 has already been subjected to secondary transfer to the sheet of recording material. Therefore, secondary-transfer residual toner, i.e., the toner that has not been transferred to the sheet of recording material during the secondary transfer, is present on the belt 61. The efficiency of secondary transfer in the image forming apparatus according to the first embodiment is 90% in the worst ambience, i.e., at 0° C. In the image forming apparatus according to the first embodiment, the maximum amount of toner carried for a four-full-color image is 200%, with the amount of toner carried for a solid black monochrome image being 100%. That is, the secondary-transfer residue that is present in the case of the maximum amount of toner carried for a full-color image of 200% is as follows: 200×0.1=20%. This amount of toner can be picked up at a time even in the ambience at 0° C. Therefore, in the case of a jam occurring in the fixing unit in step (s1), a belt cleaning sequence in step (s2) performed after normal image formation is sufficient, regardless of the detected temperature. After the residual toner on the belt is picked up by the normal cleaning sequence, the apparatus goes to stand by in step (s3) for the normal image forming operation. FIG. 6B shows where the toner image is on the belt when the registration sensor 80 shown in FIG. 1 has detected that there is no sheet of recording material. In the first embodiment, a yellow image is formed simultaneously with the pickup of a sheet of recording material P. Therefore, only the yellow image is on the belt 61 at the occurrence of a jam due to feed delay. Hence, the amount of toner is calculated from the pixel count information on the yellow image. In any cases other than the above, the stuck sheet of recording material P is present between the secondary transfer roller 66 and the fixing unit 8 (FIG. 6C). In such cases, a portion of the four-full-color image that has not been secondary-transferred to the sheet of recording material P remains on the belt 61. Since the amount of toner that has been secondary-transferred to the sheet of recording material P is unknown, the amount of toner is calculated from the pixel count information on the four-full-color image. Pickup conditions are changed on the basis of information on the ambient temperature and on the amount of toner on the belt (the amount of toner carried). According to the results of Preparatory Review 1 shown in FIG. 4, if the information obtained at the time of recovery indicates a temperature of 15° C. or higher in step (s4), recovery by Pickup Sequence 1 is possible in step (s5), regardless of the amount of toner carried. If the information obtained at the time of recovery indicates a temperature of 10° C. or higher in step (s6) and the amount of toner carried is below 40% in step (s7), recovery by Pickup Sequence 1 is possible in step (s5). If the amount of toner carried is 40% or higher in step (s7), Pickup Sequence 2 is performed in step (s8). Subsequently, the apparatus goes to stand by in step (s3). If the information obtained at the time of recovery indicates a temperature of below 10° C. and the amount of toner carried is below 30% in step (s9), recovery by Pickup Sequence 1 is possible in step (s5). If the amount of toner carried is 30% or higher in step (s9), Pickup Sequence 2 is performed in step (s8). Subsequently, the apparatus goes to stand by in step (s3). By switching between the pickup sequences in accordance with the amount of residual toner and the ambience detected at the time of recovery, pickup can be performed under optimum conditions.

In Case of Monochrome Image Formation

A pickup sequence performed when a sheet of recording material has been stuck during monochrome image formation in the first embodiment will now be described. As in the case of full-color image formation, the description will proceed with reference to the operational flow shown in FIG. 5. When a sheet of recording material P has been stuck, the position of the stuck sheet of recording material P is first detected by the registration sensor 80 and the sheet eject sensor 90 shown in FIG. 1. In a state where the jam has occurred in the fixing unit in step (s1), the sheet of recording material P has already passed the secondary transfer roller 66. Therefore, the entirety of the toner image on the belt 61 has already been subjected to secondary transfer to the sheet of recording material P, and secondary-transfer residual toner, i.e., the toner that has not been transferred to the sheet of recording material P during the secondary transfer, is present on the belt 61. The efficiency of secondary transfer in the image forming apparatus according to the first embodiment becomes the worst, specifically, 90%, in an ambience at 0° C. Hence, the secondary-transfer residue that is present in the case of the maximum amount of toner carried of 100% is as follows: 100×0.1=10%. According to the results of Preparatory Review 1, this amount of toner can be picked up at a time even in the ambience at 0° C. Therefore, Pickup Sequence 1 is sufficient. In any cases other than the jam in the fixing unit in step (s1), only a black image is on the belt 61. Therefore, the amount of toner is calculated from the video count information on the black image. Thus, the pickup sequence is determined on the basis of the amount of toner calculated as described above and the detected ambience.

In Case of Main Power Stoppage

Figure 7:
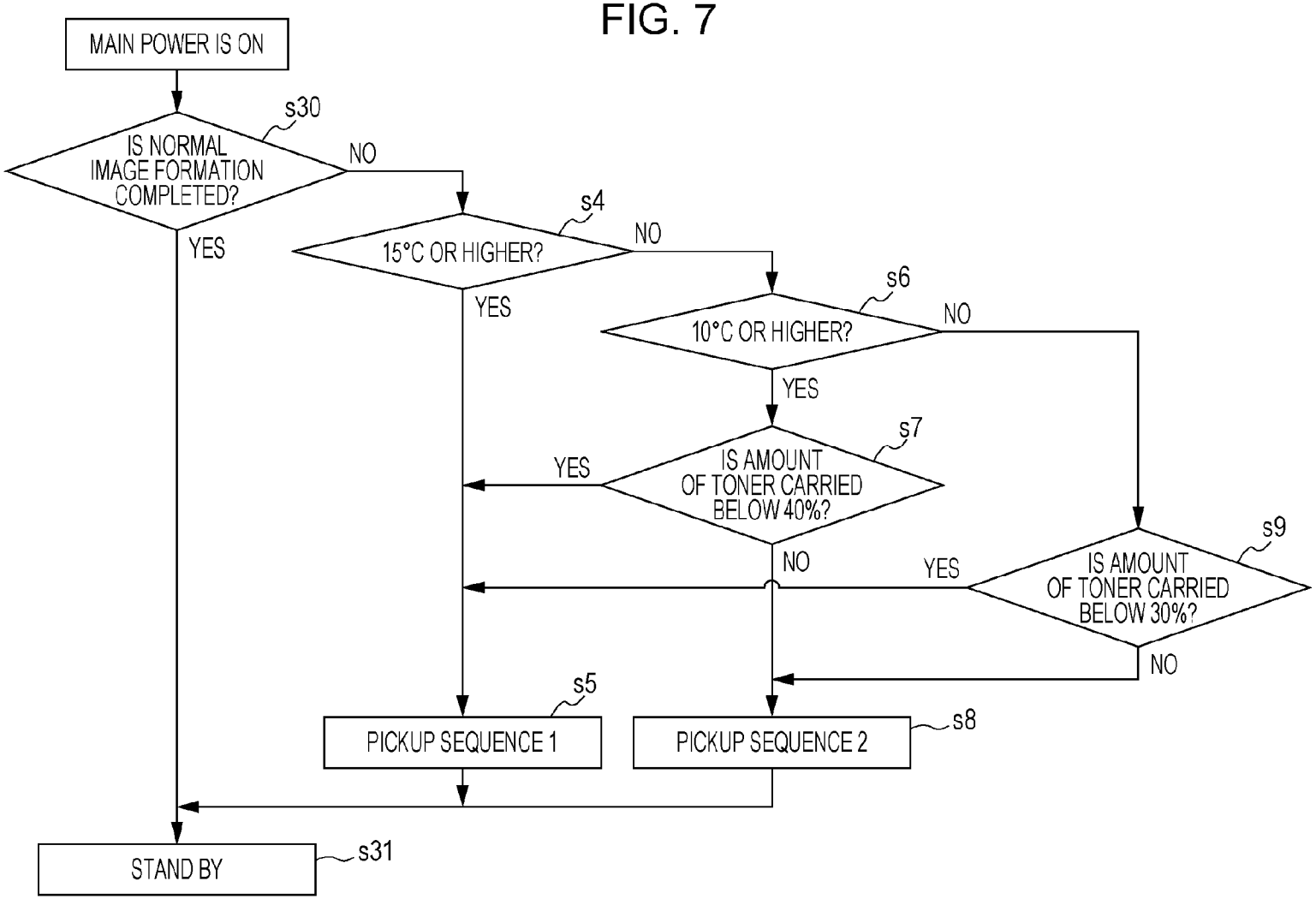
FIG. 7 is a diagram explaining an operational flow for pickup sequences performed after any emergency stop has occurred.

FIG. 7 shows an operational flow for pickup sequences performed at the occurrence of any emergency stop in the first embodiment. The cleaning unit according to the first embodiment includes a nonvolatile memory (not shown) into which information on the usage history of the drum is written without fail at the completion of every normal image forming operation. If, for example, any blackout occurs or the door of the main body is opened or closed during image formation, writing into the nonvolatile memory at the completion of image formation cannot be performed. Consequently, when the power is turned on again after the occurrence of any emergency stop due to a blackout or the like, an error is detected from the nonvolatile memory. When the power of the image forming apparatus is turned on, the nonvolatile memory is first read in step (s30). When the power is on and normal image formation is completed, the apparatus directly goes to stand by in step (s31). If an error in writing into the nonvolatile memory is detected in step (s30), it is determined that an emergency stop of the main body has occurred. In the case of such an emergency stop, however, at what point of time the emergency stop has occurred is unknown. Therefore, the position of the sheet of recording material P cannot be located. That is, it is unknown whether secondary transfer to the sheet of recording material has been completed and only the residual toner is present on the belt 61, or secondary transfer to the sheet of recording material is yet to be completed and a large amount of toner remains untransferred on the belt 61. Hence, a pickup sequence based on an assumption that a large amount of toner remains untransferred on the belt 61 is selected. Here, the pickup sequence is selected in accordance with information on the ambient temperature and the amount of toner carried. According to the results of Preparatory Review 1 shown in FIG. 4, if the information obtained at the time of recovery indicates an ambience at 15° C. or higher in step (s4), recovery by Pickup Sequence 1 is possible in step (s5), regardless of the amount of toner carried. If the information obtained at the time of recovery indicates an ambience at 10° C. or higher in step (s6) and the amount of toner carried is below 40% in step (s7), recovery by Pickup Sequence 1 is possible in step (s5). If the amount of toner carried is 40% or higher in step (s7), Pickup Sequence 2 is performed in step (s8). Subsequently, the apparatus goes to stand by in step (s31). If the information obtained at the time of recovery indicates an ambience at below 10° C. and the amount of toner carried is below 30% in step (s9), recovery by Pickup Sequence 1 is possible in step (s5). If the amount of toner carried is 30% or higher in step (s9), Pickup Sequence 2 is performed in step (s8). Subsequently, the apparatus goes to stand by in step (s31).

Thus, by switching among optimum conditions for the sequence of picking up the residual toner on the belt in accordance with information on the amount of toner carried before the occurrence of any emergency stop and on the ambience at the time of recovery, the occurrence of failure in picking up the residual toner can be assuredly prevented. The results of Preparatory Review 1 vary with the configuration of the image forming apparatus. Accordingly, the temperature and the amount of toner carried that are referred to in changing the pickup sequence may vary with the configuration of the apparatus. When the temperature is so low as likely to trigger pickup failure of the cleaning blade and high-print-rate image formation is performed, the occurrence of cleaning failure caused by a large amount of toner returned from the belt to the drum can be suppressed by switching among the optimum pickup conditions. In the first embodiment, pickup sequences are switched therebetween in accordance with the temperature and the amount of toner carried. Alternatively, in a case of an image forming apparatus that does not cause pickup failure even if the amount of toner carried on the belt 61 is the maximum, pickup sequences may be switched therebetween only in accordance with the temperature. While two pickup sequences are provided in the first embodiment so that the downtime for recovery is shortened as much as possible, the present invention is not limited thereto. Another pickup sequence may further be provided for another temperature. Moreover, while the secondary transfer roller 62 is brought into contact with the belt 61 in Pickup Sequence 2 so as to temporarily retain the residual toner, the present invention is not limited thereto. The toner charging roller may alternatively be brought into contact with the belt 61, or a separate charging member may alternatively be added.

Second Embodiment

Figure 8:
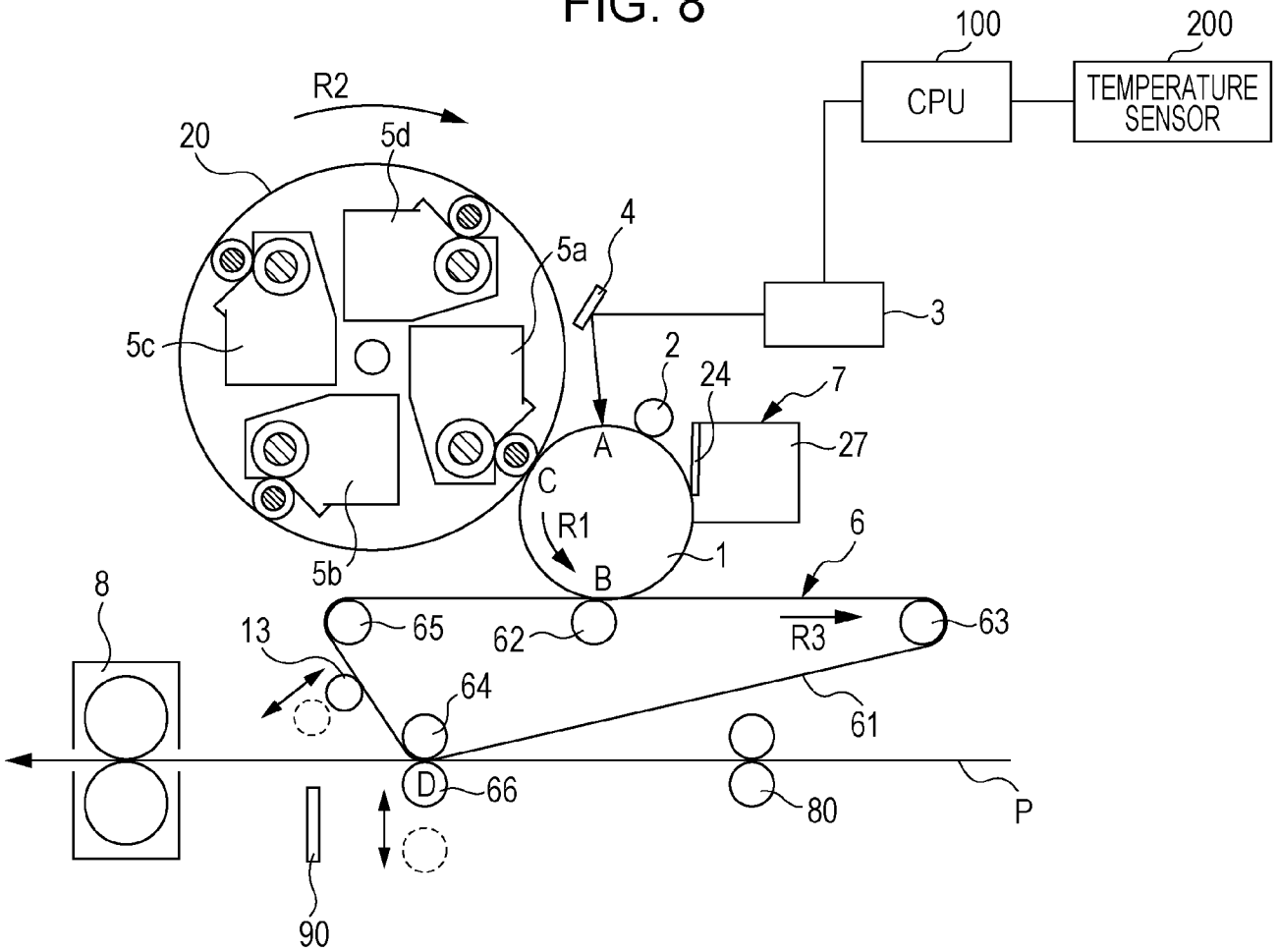
FIG. 8 is a schematic diagram of an image forming apparatus according to a second embodiment.
Figures 9A, 9B:
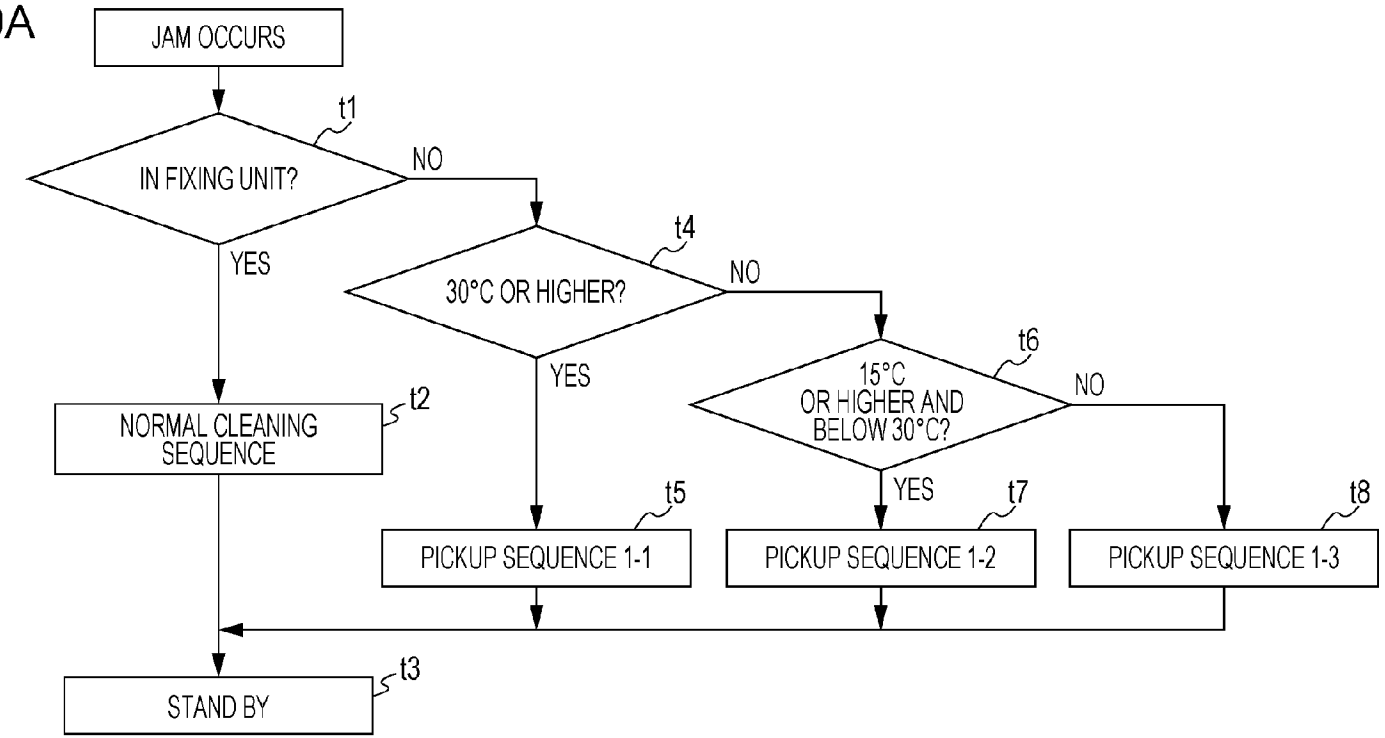
FIG. 9A is a diagram explaining an operational flow for pickup sequences performed after any jam has occurred in the second embodiment.
FIG. 9B is a diagram explaining a table provided for the pickup sequences in the second embodiment.

FIG. 8 shows an image forming apparatus according to a second embodiment. To reduce costs, the image forming apparatus does not include the pixel counting device but includes the temperature sensor. In the second embodiment, details of the pickup sequence are changed in accordance with the temperature information obtained at the occurrence of any emergency stop. Specifically, instead of using the secondary transfer roller for temporarily retaining the toner, the number of revolutions of the belt and the primary transfer bias in picking up the toner are changed. Differences from the first embodiment will now be described. The other features are the same as in the first embodiment. FIG. 9A is a flowchart of a control operation in the second embodiment. In a state where a jam has occurred during the fixing and ejecting operations in step (t1), a sheet of recording material P has already passed the secondary transfer roller 66. Therefore, the entirety of the toner image on the belt 61 has already been subjected to secondary transfer to the sheet of recording material. Hence, secondary-transfer residual toner, i.e., the toner that has not been transferred to the sheet of recording material during the secondary transfer, is present on the belt 61. The efficiency of secondary transfer in the image forming apparatus according to the second embodiment is 90% in the worst ambience, i.e., at 0° C. In the image forming apparatus according to the second embodiment, the maximum amount of toner carried for a four-full-color image is 200%, with the amount for a solid black monochrome image being 100%. That is, the secondary-transfer residue that is present in the case of the maximum amount of toner carried for a full-color image of 200% is as follows: 200×0.1=20%. This amount of toner can be picked up at a time even in the ambience at 0° C. Therefore, in the case of a jam occurring in the fixing unit in step (t1), a belt cleaning sequence in step (t2) performed after normal image formation is sufficient, regardless of the detected temperature. After the residual toner on the belt has been picked up by the normal cleaning sequence, the apparatus goes to stand by in step (t3) for the normal image forming operation. In any cases other than the jam due to feed delay and occurring during the fixing and ejecting operations in step (t1), the pickup conditions are changed in accordance with information on the ambient temperature and on the amount of toner carried. If the information obtained at the time of recovery indicates an ambience at 30° C. or higher in step (t4), recovery by Pickup Sequence 1-1 is possible in step (t5). Pickup Sequence 1-1 will now be described in detail.

(1) According to results of Preparatory Review 2, which will be described below, at a temperature of 30° C. or higher, an amount of toner carried of 95% at maximum can be picked up, with the amount of toner carried for a solid black image being 100%.

Figure 11:
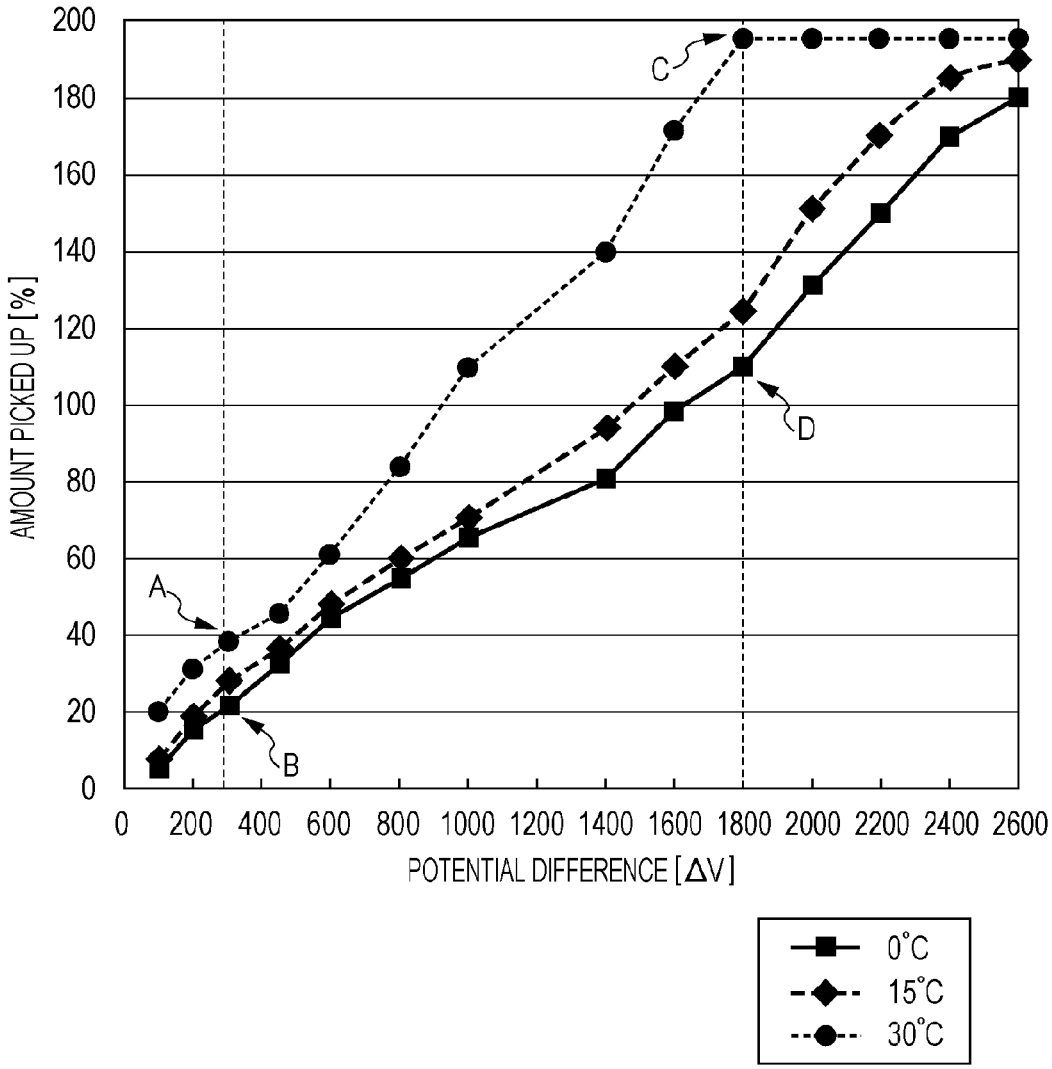
FIG. 11 is a graph showing the relationship among the potential difference between a primary transfer bias and a drum, the amount of toner picked up by the cleaning unit, and the ambient temperature.

(2) Referring to a graph of FIG. 11 showing the amount to be picked up versus the potential difference at a temperature of 30° C. in Preparatory Review 3 (FIG. 10), which will be described below, the potential difference between the drum and the belt is set such that an amount of toner carried of 95%, which has been found to be the tolerance for pickup in Preparatory Review 2, is not exceeded. In the second embodiment, the potential difference in the first revolution of the belt is controlled to be 800 V, at which an amount of toner carried of 85% can be picked up, and the potential difference in the second revolution of the belt is controlled to be 1600 V, at which an amount of toner carried of 172% can be picked up. Since an amount of toner carried of 85% has been picked up in the first revolution, the amount of toner to be picked up in the second revolution is as follows: (172%−85%)=87%. That is, an amount of toner carried of 87% is to be picked up. The potential difference in the third revolution is controlled to be 2600 V, at which an amount of 192% can be picked up. Since an amount of toner carried of 172% has been picked up in the first and second revolutions, the amount of toner to be picked up in the third revolution is as follows: (192%−172%)=20%. That is, an amount of toner carried of 20% is to be picked up. In this manner, the amount to be picked up per revolution is set so as not to exceed an amount of toner carried of 95%, as considered in (1). A table (See FIG. 9(*b*)) summarizing such settings is stored in the memory. The settings are made such that the magnitude of the electric field produced between the belt and the drum is increased in a graded manner. To produce a potential difference between the belt 61 and the drum 1, the bias application to the charging roller is turned off, whereas a negative voltage is applied to the transfer roller. Thus, a desired potential difference is produced.

(3) The amount to be picked up with each of the biases applied is set so as to be saturated in one revolution of the belt. Therefore, the bias is changed for each revolution of the belt.

(4) After the toner on the belt is picked up for three revolutions of the belt, the following is performed while the belt 61 completes another revolution: the secondary transfer roller 66 and the toner charging roller 13 are brought into contact with the belt 61, and a positive bias of 700 V is applied to each of the secondary transfer roller 66 and the toner charging roller 13, whereby the residual toner on the belt 61 is positively charged. The primary transfer roller 62 is charged with a positive bias. The drum 1 is negatively charged, with the dark-area potential of the drum being −500 V. Consequently, the positively charged toner is picked up at the primary transfer nip portion B by the drum with the aid of an electric field. In operation (4), the negatively charged toner that has not been picked up in operation (2) and the positively charged toner are picked up.

(5) Subsequently, to discharge toner adhered to the secondary transfer roller 66 and the toner charging roller 13 in operation (4), a positive bias and a negative bias are applied alternately and periodically. In this operation, the charging biases are alternated in such a manner as to produce an electric field causing the toner discharged from the secondary transfer roller 66 and the toner charging roller 13 to be picked up at the primary transfer nip portion B by the drum 1. Thus, the discharged toner is picked up by the drum. The duration of each application is 350 msec. While the belt 61 completes one and a half revolutions, the alternate application is repeated, whereby the discharged toner is picked up by the drum.

As shown in FIG. 9A, it is set such that Pickup Sequences 1-1, 1-2, and 1-3 are switched thereamong in accordance with the temperature. Taking results of Preparatory Reviews 2 to 4 into account, details of operation (2) are set for different temperatures for each of Pickup Sequences 1-2 and 1-3, as are for Pickup Sequence 1-1. If the information obtained at the time of recovery indicates a temperature of 15° C. or higher and below 30° C. in step (t6), recovery by Pickup Sequence 1-2 is possible in step (t7). If the information indicates a temperature of below 15° C. in step (t6), Pickup Sequence 1-3 is performed in step (t8). Subsequently, the apparatus goes to stand by in step (t3). Thus, since the tolerable amount that can be picked up by the cleaning unit varies with the ambient temperature at the time of recovery, the duration of the pickup sequence varies with temperature. In the second embodiment, the potential difference produced between the belt 61 and the drum 1 in the first revolution of the belt is larger in Pickup Sequence 1-1 provided for high temperature than in Pickup Sequence 1-2 provided for low temperature. That is, the electric field between the intermediate transfer member and the image bearing member that is produced when the toner on the belt 61 is returned to the drum 1 for the first time at the occurrence of any emergency stop is smaller in Pickup Sequence 1-2 than in Pickup Sequence 1-1. This is because the amount of toner to be returned from the belt 61 to the drum 1 for each unit area of the drum 1 increases as the potential difference increases. That is, as the potential difference increases, a larger amount of toner is transferred from the belt 61 to the drum 1. Therefore, when the temperature is low and the tolerable amount of pickup during cleaning is small, the potential difference is reduced, so that a large amount of toner is prevented from returning to the drum 1. When the temperature is low, however, while the amount of toner to be transferred from the belt 1 to the drum is reduced, the number of revolutions of the belt 61 during the pickup sequence is increased. Therefore, when the temperature is low, the duration of the pickup sequence is long.

As described above, when the temperature is low and the tolerable amount that can be picked up at a time by the cleaning device is small, the amount of toner to be returned from the belt 61 to the drum 1 for each unit area of the drum 1 is reduced. Thus, the occurrence of cleaning failure can be suppressed, although the duration of the pickup sequence is long. In contrast, when the temperature is high and the tolerable amount that can be picked up at a time by the cleaning device is large, the amount of toner to be returned from the belt 61 to the drum 1 for each unit area of the drum 1 is increased. Thus, the duration of the pickup sequence can be shortened.

Preparatory Review 2

A review was conducted about the relationship between the limit of the amount of toner that could be picked up by the cleaning unit according to the second embodiment without causing pickup failure of the cleaning blade and the corresponding ambient temperature around the image forming apparatus. As in Preparatory Review 1, the review was conducted with a drum whose cleanability had been reduced after image formation, specifically, with a cleaning unit (having a nominal drum life for 80000 sheets) that had undergone the running of full-color 80000 sheets in the image forming apparatus according to the second embodiment.

Method

Monochrome images (in this review, Bk toner was used) having various densities were developed on the drum of the image forming apparatus according to the second embodiment, and a primary transfer bias having the same polarity as the toner was applied, whereby the toner developed on the drum was prevented from being primary-transferred to the intermediate transfer member. In such an operation, the toner image developed on the drum was directly picked up by the cleaning device. The review was conducted to find whether or not the toner image thus picked up by the cleaning device slipped through the cleaning blade. Specifically, an area of the drum swept by the cleaning blade was visually examined, and whether or not slipping-through of toner had occurred was checked. This review was conducted at a processing speed the same as the speed at which plain paper is caused to run through the image forming apparatus. The occurrence of slipping-through was regarded as pickup failure.

Results

The results are shown in FIG. 10. The horizontal axis represents the ambient temperature around the image forming apparatus, and the vertical axis represents the amount of toner carried, with the amount of toner carried for a solid black monochrome image being 100%. Cases where slipping-through of toner did not occur are represented by NO, and cases where slipping-through of toner occurred are represented by YES.

According to the results, in the cleaning unit that had outlived its durability life, the amount of toner to be picked up by the drum needed to be set to 30% or lower in an ambience at 0° C., with the amount of toner carried for a solid black monochrome image being 100%. In contrast, in an ambience at 30° C., an amount of 95% was able to be picked up.

Preparatory Review 3

A review was conducted about the relationship between the primary transfer bias and the amount of toner on the belt 61 to be picked up by the drum in the image forming apparatus according to the second embodiment.

Method

In the image forming apparatus according to the second embodiment, the maximum amount of toner carried for a four-full-color image is 200% as mentioned above, with the amount for a solid black monochrome image being 100%. This amount of toner carried of 200% was developed (in this review, printing was performed with an amount of toner of 100% for each of Y and Bk), and an image that had been primary-transferred to the intermediate transfer member was picked up by the drum without being secondary-transferred. In this review, the amounts of toner adhered to the drum, i.e., the amounts of toner picked up by the drum, with different biases applied during a period from when the leading end of the residual toner image had been picked up by the drum until when the drum had completed one revolution were measured and compared. This review was conducted at a processing speed the same as the speed at which plain paper is caused to run through the image forming apparatus.

Results

FIG. 11 is a graph showing the relationship between different primary transfer biases and the corresponding amounts of toner that was picked up by the drum. The horizontal axis of this graph represents the primary-transfer cleaning bias. The primary-transfer cleaning bias represents the difference between the potential of the drum and the potential of the bias applied to the primary transfer roller. The direction of the electric field corresponds to the direction in which toner having the normal polarity (negatively charged toner) is transferred to the drum. As the primary-transfer cleaning bias increased, a larger electric field was produced between the belt 61 and the drum 1, and a larger amount of toner was returned from the belt 61 to the drum 1. The vertical axis represents the amount of toner that was picked up by the drum when each of the different primary-transfer cleaning biases were applied. Referring to FIG. 11, for example, when the primary-transfer cleaning bias was set to 300 V in an ambience at 30° C., 38% out of the maximum amount of toner carried of 200% could be picked up (A in the graph). In contrast, when the primary-transfer cleaning bias was set to 300 V in an ambience at 0° C., only 20% out of the maximum amount of toner carried of 200% could be picked up (B in the graph). When the primary-transfer cleaning bias was set to 1800 V in an ambience at 30° C., 190% out of the maximum amount of toner carried of 200% could be picked up (C in the graph). In contrast, when the primary-transfer cleaning bias was set to 1800 V in an ambience at 0° C., only 110% out of the maximum amount of toner carried of 200% could be picked up (D in the graph). This has been concluded that the amount to be picked up varies because of variations in the amount of charge of the residual toner occurring with variations in the ambience. With the image forming apparatus according to the second embodiment, it was difficult to transfer all of the toner on the belt to the drum only with the aid of the electric field produced between the belt and the drum, because of the image force acting between the belt 61 and the toner and van der Waals forces. Nevertheless, after most of the toner has been picked up by the drum, the amount of toner is reduced to such a level that the toner charging roller is not contaminated. Therefore, 100% of the residual toner on the belt can be ultimately picked up by lastly performing belt cleaning by a normal method of picking up the secondary-transfer residual toner.

Preparatory Review 4

In the image forming apparatus according to the second embodiment, the primary-transfer cleaning bias was fixed to a specific value, and the toner on the belt was picked up by the drum while the belt and the drum were rotated. In this situation, a review was conducted about the relationship between the number of revolutions by which the belt had been driven and the rate of toner that had been picked up by the cleaning device.

Method

A solid black monochrome image (in this review, Bk toner was used) was developed in the image forming apparatus according to the second embodiment, and the solid black image that had been primary-transferred to the belt was picked up at the primary transfer nip portion B by the drum without being secondary-transferred. During this process, the primary-transfer cleaning bias was fixed at 300 V. In such a situation, the amount of residual toner on the belt was measured for each of the revolutions of the intermediate transfer belt that had been continuously rotated.

Results

Figure 12:
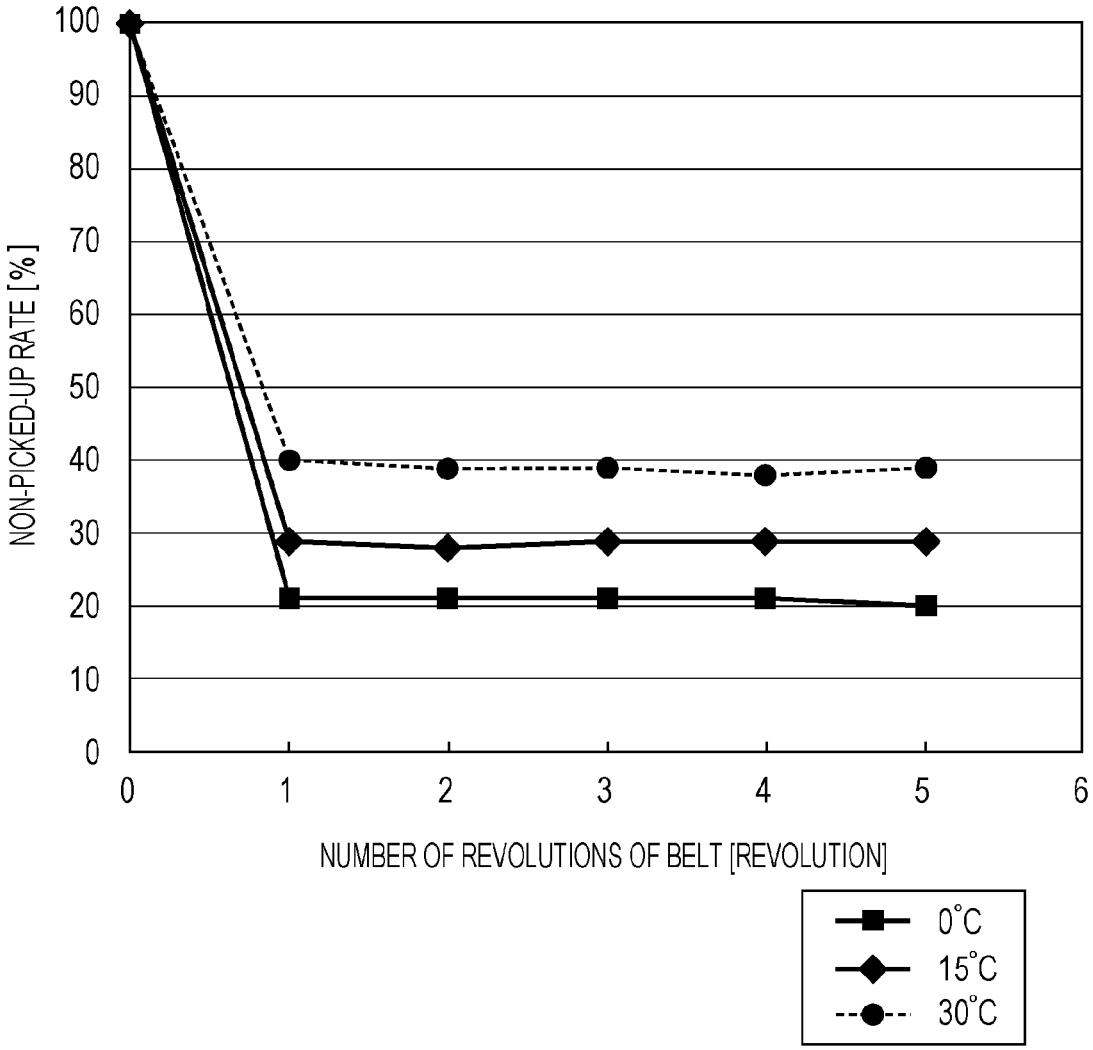
FIG. 12 is a graph showing the relationship between the number of revolutions of a belt and the rate of non-picked-up toner in different ambiences.

FIG. 12 is a graph showing the relationship between the number of revolutions of the belt, i.e., how many revolutions the belt was rotated, and the rate of toner that was picked up by the drum. The horizontal axis represents the number of revolutions of the belt. The drum rotated by 3.5 revolutions per revolution of the belt. The vertical axis represents the non-picked-up rate, i.e., the rate of toner remaining on the belt that had not been picked up by the drum, for each of the revolutions of the belt. The non-picked-up rate was calculated as a ratio of the amount of toner for the solid black image formed on the belt to the amount of toner picked up by the drum. A non-picked-up rate of 100% means that the entirety of the solid black image remained on the belt, and a non-picked-up rate of 0% means that the entirety of the image had been picked up by the drum and no toner remained on the belt. For example, 50% on the vertical axis means that half the amount of toner for the solid black monochrome image remained on the belt, not having been picked up by the drum. The results were obtained from pickup operations performed during five revolutions of the belt. The non-picked-up rate showed substantially no changes after the second and subsequent revolutions of the belt, and the amount picked up did not increase. That is, when it was attempted to return the toner on the belt to the drum with the aid of a specific electric field, the toner was not picked up from the belt by the drum in the second and subsequent revolutions of the belt with the unchanged electric field. The reason for this is considered that the toner on the belt has a distribution of its charges, and the amount of toner that can be picked up with a fixed bias is limited. In the first embodiment in which the amount of charge of the toner is adjusted within an appropriate range to some extent by the secondary transfer roller and so forth, the toner can be returned with a fixed electric field. According to the results of Preparatory Review 4, it has been found that, when the primary-transfer cleaning bias is fixed, there is an upper limit for the amount of toner that can be returned from the belt to the drum, and the upper limit does not change even if the number of revolutions of the belt is increased. Therefore, if not all of the toner on the belt 61 can be picked up with a certain primary-transfer cleaning bias, the primary-transfer cleaning bias needs to be changed.

The results of Preparatory Reviews 2 to 4 vary with the configuration of the image forming apparatus. Accordingly, the temperature and the amount of toner carried that are referred to in changing the pickup sequence may vary with the configuration of the apparatus. In the second embodiment, the pickup conditions are changed such that, as the temperature during image formation at the time of recovery becomes lower, the pickup operation in the first revolution of the belt is performed with a smaller electric field produced between the belt 61 and the drum 1. By reducing the magnitude of the electric field, the amount of toner to be returned from the belt 61 to the drum 1 at a time is reduced.

Thus, in a low-temperature ambience in which pickup failure due to the cleaning blade tends to occur, the occurrence of cleaning failure due to a large amount of toner returned from the belt to the drum can be suppressed. In contrast, in any ambiences, other than the ambience at low temperature, in which cleaning failure does not tend to occur, the magnitude of the electric field produced between the belt 61 and the drum 1 is increased, whereby the amount of toner to be returned from the belt 61 to the drum 1 at a time is increased. Thus, the duration of the cleaning operation is shortened.

While the second embodiment concerns the case where the electric field produced between the belt and the drum is changed by changing the bias to be applied to the primary transfer means, the present invention is not limited thereto. For example, instead of changing the bias to be applied to the primary transfer means, the bias to be applied to the charging means for charging the drum may be changed.

Third Embodiment

In the second embodiment, the pickup conditions are changed in accordance with the temperature by changing the primary transfer bias, not by causing the toner to adhere to the secondary transfer roller 66 and so forth. In a third embodiment, the pixel counting device is provided as shown in FIG. 1, and the pickup conditions for the operation performed after any emergency stop by utilizing the primary transfer bias are changed in accordance with information on the amounts of toner carried based on pixels and the temperature. Differences from the second embodiment will now be described. The other features are the same as in the second embodiment.

In Case of Stuck Sheet of Recording Material

When the occurrence of a jam is detected by the sheet eject sensor 90 during the fixing and ejecting operations, the toner image on the belt 61 is positioned as shown in FIG. 6A, the same as in the first embodiment. In such a situation, the secondary-transfer residual toner on the belt can be picked up by the normal cleaning sequence, regardless of the ambience and the print rate. Therefore, after the residual toner on the belt is picked up by the normal cleaning sequence, the apparatus goes to stand by for the normal image forming operation. FIG. 6B shows where the toner image is on the belt when the registration sensor 80 has detected that there is no sheet of recording material. In the third embodiment, a yellow image is formed simultaneously with the pickup of a sheet of recording material P. Therefore, only the yellow image is on the belt 61 at the occurrence of a jam due to feed delay. Hence, the amount of toner is calculated from the pixel count information on the yellow image. In any cases other than the above, a stuck sheet of recording material P is present between the secondary transfer roller 66 and the fixing unit 8 (FIG. 6C). In such cases, a portion of the four-full-color image that has not been secondary-transferred to the sheet of recording material P remains on the belt 61. Since the amount of toner that has been secondary-transferred to the sheet of recording material P is unknown, the amount of toner is calculated from the pixel count information on the four-full-color image.

Figure 13:
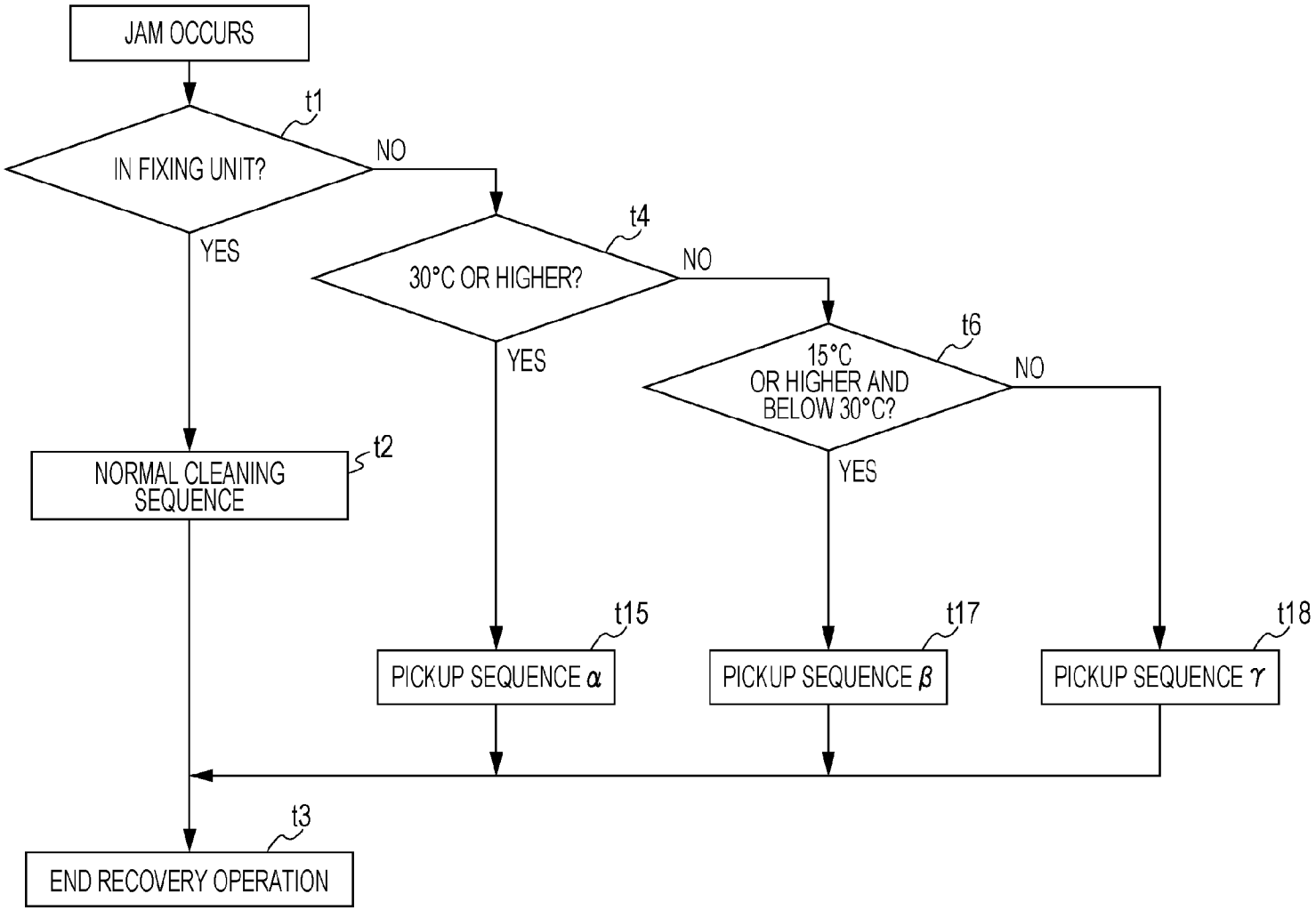
FIG. 13 is a diagram explaining an operational flow for pickup sequences performed after any jam has occurred in a third embodiment.
Figure 15:
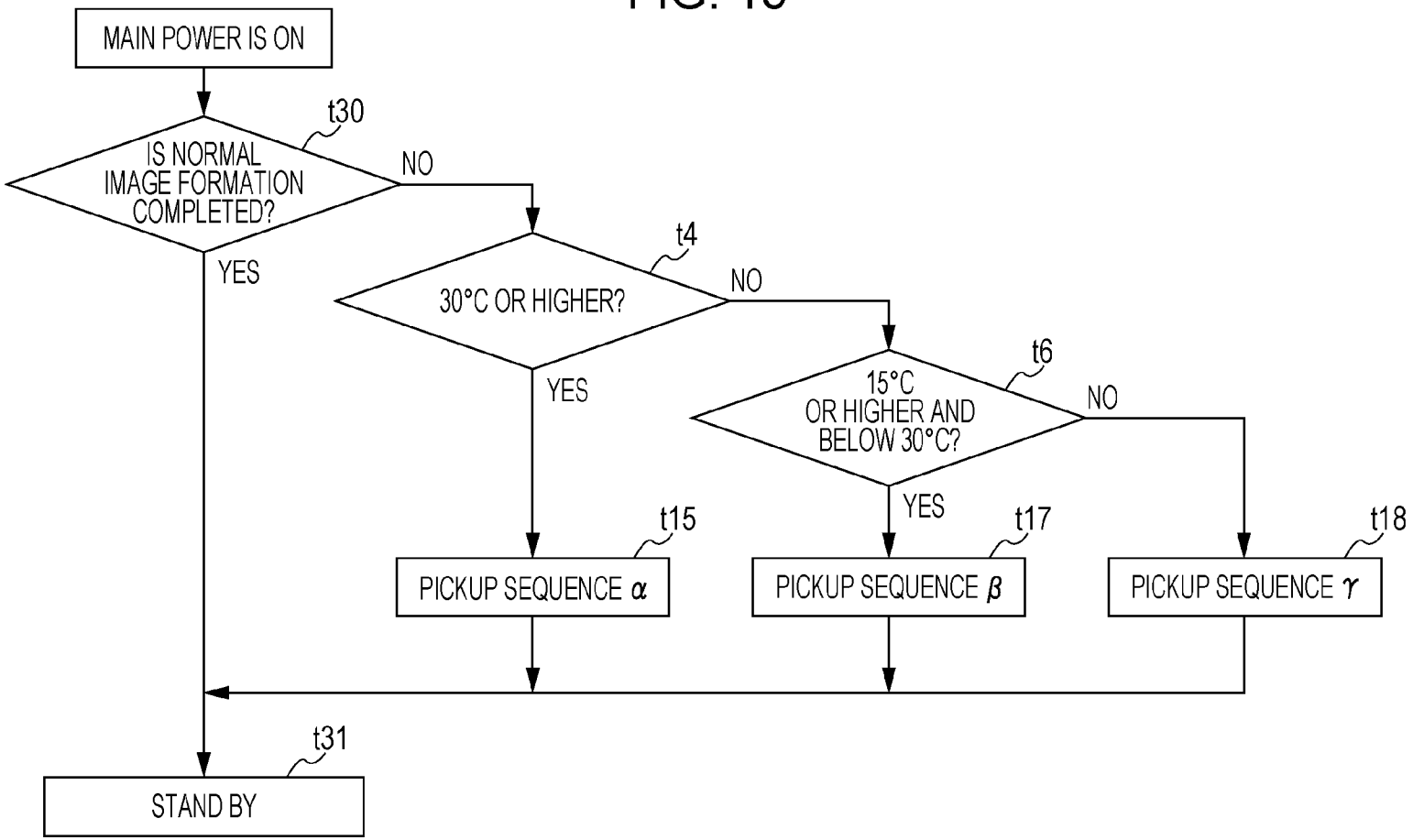
FIG. 15 is a diagram explaining an operational flow for pickup sequences performed after any emergency stop has occurred in the third embodiment.

On the basis of the amount of residual toner thus calculated; the detected ambience; and the results of Preparatory Reviews 2 to 4, the pickup sequence (FIG. 13) is determined. As shown in FIG. 13, Pickup Sequences α, β, and γ are switched thereamong in accordance with the temperature. As can be seen from FIG. 14, as the amount of toner carried increases, the number of revolutions of the belt in the pickup sequence therefore increases because the amount of toner to be picked up increases. Moreover, since the tolerable amount of pickup varies, the length by which the belt is to be rotated in the pickup sequence increases depending on the ambience. In cases of jams other than those occurring during the fixing and ejecting operations in step (t1), the pickup conditions are changed in accordance with information on the ambient temperature and on the amount of toner carried. If the ambient information obtained at the time of recovery indicates a temperature of 30° C. or higher in step (t4) in FIG. 13, recovery by Pickup Sequence α is possible in step (t15), according to the results of Preparatory Reviews 2 to 4. Pickup Sequence α is based on a table, shown in FIG. 14, summarizing biases to be applied corresponding to the numbers of revolutions of the belt for different amounts of toner carried. If the ambient temperature at the time of recovery is 30° C. or higher and the amount of toner carried is 100%, recovery is possible after a downtime corresponding to two revolutions of the belt. If the ambient information obtained at the time of recovery indicates a temperature of 15° C. or higher and below 30° C. in step (t6), Pickup Sequence β is performed in step (t17). If the ambient information indicates a temperature of below 15° C. in step (t6), Pickup Sequence γ is performed. Thus, by switching among the pickup sequences in accordance with the amount of residual toner on the belt and the detected ambience at the time of recovery, pickup can be performed under optimum conditions.

In Monochrome Case

The operation performed when a sheet of recording material is stuck during monochrome image formation in the third embodiment is similar to that in the case of full-color image formation. Since only a black image is present, the amount of toner is calculated from the pixel count information on the black image. On the basis of the amount of toner thus calculated and the detected ambience, any of the pickup sequences shown in FIG. 13 is performed.

In Case of Main Power Stoppage

When the power of the image forming apparatus is turned on, the nonvolatile memory is read. When the power is on and normal image formation is completed, the apparatus directly goes to stand by.

If a writing error is detected, it is determined that an emergency stop of the main body has occurred. The operational flow of the pickup sequence performed at the occurrence of such an emergency stop is substantially the same as that shown in FIG. 13.

Unlike the case of a jam, however, at what point of time such an emergency stop has occurred is unknown. Therefore, the position of the sheet of recording material P cannot be located. Hence, a pickup sequence based on an assumption that toner remains on the belt 61 as shown in FIG. 6B is selected. Accordingly, the amount of toner is calculated from the pixel count information on the full-color image obtained before the emergency stop. On the basis of the amount of toner thus calculated and the detected ambience, the pickup sequence is determined. In this case, Pickup Sequences α, β, and γ are provided. Thus, by optimizing the conditions for picking up the residual toner on the belt in accordance with the image information obtained before the emergency stop and the ambient information obtained at the time of recovery, the occurrence of failure in picking up the residual toner can be assuredly prevented.

While the first to third embodiments each concern the case where the cleaning blade is made of urethane rubber, the present invention is not limited thereto and may alternatively be practicable with an elastic blade having an improved resistance to abrasion and made of any of materials such as silicon rubber, isoprene rubber, NBR rubber, EPDM rubber, and the like. The point of the present invention is to switch between a first pickup sequence and a second pickup sequence in accordance with the temperature when the pickup sequence is performed. The second pickup sequence is set such that the amount of toner to be returned from the belt to the drum for each unit area of the drum is smaller than that in the first pickup sequence. Letting a specific temperature be a first temperature and another temperature lower than the first temperature be a second temperature, the CPU performs the first pickup sequence at the first temperature and the second pickup sequence at the second temperature.

Furthermore, in the case where toner is transferred to the drum 1 with the aid of an electric field produced between the belt 61 and the drum 1, the electric field for the second pickup sequence is set so as to be smaller than that for the first pickup sequence.

Furthermore, in the case where the apparatus includes a counting device that calculates information on the amount of toner that is present on the belt 61 at the occurrence of any emergency stop, the pickup sequences are switched therebetween in accordance with the amount of toner. Here, let amounts of toner that is present on the belt at the occurrence of the emergency stop be a first amount of toner and a second amount of toner larger than the first amount of toner, respectively. In this case, the number of revolutions of the belt 61 during the pickup sequence for the second amount of toner is set larger than that for the first amount of toner.

The present invention is not limited to the above embodiments, and various changes and modifications can be made thereto without departing from the spirit and scope of the present invention. Accordingly, the appended claims are given so as to publicize the scope of the present invention.

According to the present invention, an optimum recovery operation is performed after any emergency stop such as a jam of recording material, whereby an optimum pickup operation can be performed without causing cleaning failure.

This application claims the benefit of International Patent Application No. PCT/JP2010/053502, filed Mar. 4, 2010, which is hereby incorporated by reference herein in its entirety.

What is claimed is:

1. An image forming apparatus including an image bearing member configured to bear a latent image;

a developing device configured to develop the latent image with toner;

a primary transfer device configured to transfer a toner image formed on the image bearing member to an intermediate transfer member;

a secondary transfer device configured to transfer the toner image primary-transferred to the intermediate transfer member to a sheet of recording material; and a cleaning device including an elastic cleaning blade being in contact with the image bearing member, the cleaning device being configured to pick up the toner remaining on the image bearing member, the image forming apparatus comprising:

a control device configured to control a pickup sequence in which, after the image forming apparatus has caused any emergency stop, the toner on the intermediate transfer member is returned from the intermediate transfer member to the image bearing member by rotating the intermediate transfer member, whereby the toner is picked up by the cleaning device; and a temperature detecting device configured to detect a temperature when the pickup sequence is performed, wherein, letting temperatures to be detected by the temperature detecting device be a first temperature and a second temperature lower than the first temperature, respectively, the pickup sequence includes a first pickup sequence to be performed at the first temperature and a second pickup sequence to be performed at the second temperature, and wherein the second pickup sequence is set such that an amount of toner to be returned from the intermediate transfer member to the image bearing member for each unit area of the image bearing member is smaller than that for the first pickup sequence.

2. The image forming apparatus according to claim 1, further comprising a retaining device configured to temporarily retain some of the toner on the intermediate transfer member other than that picked up by the cleaning device, wherein, in the second pickup sequence, some of the toner that is present on the intermediate transfer member at the occurrence of the emergency stop is retained by the retaining device.

3. The image forming apparatus according to claim 2, wherein the second pickup sequence ends by transferring the toner retained by the retaining device to the intermediate transfer member and then from the intermediate transfer member to the image bearing member.

4. The image forming apparatus according to claim 2, wherein the retaining device is the secondary transfer device and, in a state where the sheet of recording material is absent between the secondary transfer device and the intermediate transfer member, some of the toner on the intermediate transfer member is retained by the secondary transfer device.

5. The image forming apparatus according to claim 2, further comprising a toner charging device configured to charge the toner on the intermediate transfer member so as to transfer the toner on the intermediate transfer member to the image bearing member after the completion of image formation, wherein the retaining device is the toner charging device.

6. The image forming apparatus according to claim 1, wherein the amount of toner to be returned from the intermediate transfer member to the image bearing member for each unit area of the image bearing member is changed by changing the magnitude of an electric field produced between the intermediate transfer member and the image bearing member, wherein, in each of the pickup sequences, a condition set for the electric field produced between the intermediate transfer member and the image bearing member is changed in a graded manner such that the electric field becomes larger, and wherein the electric field produced between the intermediate transfer member and the image bearing member when the toner that is present on the intermediate transfer member at the occurrence of the emergency stop is returned from the intermediate transfer member to the image bearing member for the first time is smaller in the second pickup sequence than in the first pickup sequence.

7. The image forming apparatus according to claim 6, wherein the number of revolutions by which the intermediate transfer member is rotated in each of the pickup sequences is larger in the second pickup sequence than in the first pickup sequence.

8. The image forming apparatus according to claim 6, further comprising a calculating device configured to calculate information on an amount of toner that is present on the intermediate transfer member when the image forming apparatus has caused the emergency stop, wherein, letting amounts of toner, calculated by the calculating device, that is present on the intermediate transfer member at the occurrence of the emergency stop be a first amount of toner and a second amount of toner larger than the first amount of toner, respectively, the number of revolutions by which the intermediate transfer member is rotated in each of the pickup sequences is larger for the second amount of toner than for the first amount of toner.

9. The image forming apparatus according to claim 1, wherein the cleaning blade is made of urethane rubber.

10. An image forming apparatus including an image bearing member configured to bear a latent image;

a developing device configured to develop the latent image with toner;

a primary transfer device configured to transfer a toner image formed on the image bearing member to an intermediate transfer member;

a secondary transfer device configured to transfer the toner image primary-transferred to the intermediate transfer member to a sheet of recording material; and a cleaning device including an elastic cleaning blade being in contact with the image bearing member, the cleaning device being configured to pick up the toner remaining on the image bearing member, the image forming apparatus comprising:

a control device configured to control a pickup sequence in which, after the image forming apparatus has caused any emergency stop, the toner on the intermediate transfer member is returned from the intermediate transfer member to the image bearing member by rotating the intermediate transfer member, whereby the toner is picked up by the cleaning device;

a temperature detecting device configured to detect a temperature when the pickup sequence is performed; and a calculating device configured to calculate information on an amount of toner that is present on the intermediate transfer member when the image forming apparatus has caused the emergency stop, wherein, letting temperatures to be detected by the temperature detecting device be a first temperature and a second temperature lower than the first temperature, respectively; and letting amounts of toner, calculated by the calculating device, that is present on the intermediate transfer member at the occurrence of the emergency stop be a first amount of toner and a second amount of toner larger than the first amount of toner, respectively, the pickup sequence includes a first pickup sequence to be performed at the first temperature whether the first amount of toner or the second amount of toner, or at the second temperature and for the first amount of toner, and a second pickup sequence to be performed at the second temperature and for the second amount of toner, and wherein the second pickup sequence is set such that an amount of toner to be returned from the intermediate transfer member to the image bearing member for each unit area of the image bearing member is smaller than that for the first pickup sequence.

11. The image forming apparatus according to claim 10, further comprising a retaining device configured to temporarily retain some of the toner on the intermediate transfer member other than that picked up by the cleaning device, wherein, in the second pickup sequence, some of the toner that is present on the intermediate transfer member at the occurrence of the emergency stop is retained by the retaining device.

12. The image forming apparatus according to claim 11, wherein the second pickup sequence ends by transferring the toner retained by the retaining device to the intermediate transfer member and then from the intermediate transfer member to the image bearing member.

13. The image forming apparatus according to claim 11, wherein the retaining device is the secondary transfer device and, in a state where the sheet of recording material is absent between the secondary transfer device and the intermediate transfer member, some of the toner on the intermediate transfer member is retained by the secondary transfer device.

14. The image forming apparatus according to claim 11, further comprising a toner charging device configured to charge the toner on the intermediate transfer member so as to transfer the toner on the intermediate transfer member to the image bearing member after the completion of image formation, wherein the retaining device is the toner charging device.

15. The image forming apparatus according to claim 10, wherein the cleaning blade is made of urethane rubber.

* * * * *